US009902583B2

(12) United States Patent
Tanaka

(10) Patent No.: US 9,902,583 B2
(45) Date of Patent: Feb. 27, 2018

(54) LENGTHY ARTICLE TAKE-UP APPARATUS AND LENGTHY ARTICLE PRINTER

(71) Applicant: Mitsugi Tanaka, Nagoya (JP)

(72) Inventor: Mitsugi Tanaka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 264 days.

(21) Appl. No.: 14/169,460

(22) Filed: Jan. 31, 2014

(65) Prior Publication Data

US 2014/0209730 A1 Jul. 31, 2014

(30) Foreign Application Priority Data

Jan. 31, 2013 (JP) ..... 2013-017212

(51) Int. Cl.
*B65H 18/10* (2006.01)
*B41J 15/04* (2006.01)
(Continued)

(52) U.S. Cl.
CPC ..... *B65H 18/10* (2013.01); *B41J 15/04* (2013.01); *B41J 15/042* (2013.01); *B41J 15/16* (2013.01);
(Continued)

(58) Field of Classification Search
CPC . B60R 22/405; B60R 22/287; B60R 22/3419; B60R 22/36; B65H 18/10;
(Continued)

(56) References Cited

U.S. PATENT DOCUMENTS 4,226,387 A * 10/1980 Karlsson ..... A01K 89/015 242/249
4,350,313 A * 9/1982 Adomeit ..... B60R 22/405 242/376.1
(Continued)

FOREIGN PATENT DOCUMENTS

JP H05-077824 A 3/1993
JP H11-255383 A 9/1999
(Continued)

OTHER PUBLICATIONS

Extended EP Search Report dated May 20, 2014, EP App 14152905.7.

*Primary Examiner* — Michael Gallion
(74) *Attorney, Agent, or Firm* — Banner & Witcoff, Ltd.

(57) ABSTRACT

A lengthy article take-up apparatus includes a housing, a winding core member, a bearing portion and a driving gear is provided. The winding core member is configured to take up the lengthy article. The winding core member includes a shaft member, a cylindrical winding body, a driven gear, and a lock member. The shaft member is configured to be detachably fitted to the bearing portion. The cylindrical winding body is disposed rotatably on an outer periphery of the shaft member and configured to wind the lengthy article on an outer peripheral side. The driven gear is fixed to the winding body and configured to be meshed with the driving gear when the winding core member is attached to the housing. The lock member is configured to fix the shaft member to the bearing portion when the winding core member is attached to the housing.

11 Claims, 28 Drawing Sheets

(51) Int. Cl.
*B41J 15/16* (2006.01)
*B65H 19/30* (2006.01)
*B65H 75/18* (2006.01)

(52) U.S. Cl.
CPC ..... *B65H 19/305* (2013.01); *B65H 75/185* (2013.01); *B65H 2301/4131* (2013.01); *B65H 2301/41464* (2013.01); *B65H 2301/413683* (2013.01); *B65H 2402/64* (2013.01); *B65H 2801/12* (2013.01)

(58) Field of Classification Search
CPC ..... B65H 19/305; B65H 75/185; B65H 2301/4131; B65H 2301/413683; B65H 2301/41464; B65H 2402/64; B65H 2801/12; B41J 15/042; B41J 15/04; B41J 15/16
See application file for complete search history.

(56) References Cited

U.S. PATENT DOCUMENTS 4,509,707 A * 4/1985 Ernst ..... B60R 22/36 242/376.1
4,564,155 A * 1/1986 Tsukamoto ..... B60R 22/405 242/383.3
4,762,285 A * 8/1988 Allred ..... B65H 54/106 242/486.9
4,858,835 A * 8/1989 Luciani ..... H02K 15/095 242/432.4
4,874,143 A * 10/1989 Armstrong ..... G11B 23/287 242/338.3
4,952,312 A * 8/1990 Zantonelli ..... B01D 63/021 210/321.74
5,044,575 A * 9/1991 Knabel ..... B60R 22/42 242/381.4
5,266,966 A * 11/1993 Fushimi ..... B41J 25/304 347/220
5,312,066 A * 5/1994 Haston ..... B60R 22/34 242/383.2
5,619,240 A * 4/1997 Pong ..... B41J 11/0095 347/103
5,775,820 A * 7/1998 Sugimoto ..... B41J 2/325 347/197
5,794,867 A * 8/1998 Hermanns ..... B65H 54/2893 242/477.2
5,839,790 A * 11/1998 Doty ..... B60R 22/405 297/478
5,906,325 A * 5/1999 Harrison, Jr. ..... B66D 1/7405 226/189
5,921,496 A * 7/1999 Matsuki ..... B60R 22/405 242/383.2
6,024,322 A * 2/2000 Skelly ..... B41J 29/48 116/67 A
6,132,119 A 10/2000 Nakajima et al.
D726,815 S * 4/2015 Tanaka ..... D18/56
2002/0005448 A1* 1/2002 Sumiyashiki ..... B60R 22/405 242/383.2
2003/0132334 A1* 7/2003 Koning ..... B60R 21/04 242/382
2004/0206847 A1* 10/2004 Schanke ..... B65H 16/10 242/423.1
2005/0211743 A1* 9/2005 Mandar ..... B65H 35/002 225/56
2006/0022079 A1* 2/2006 Koide ..... B60R 22/44 242/390.8
2006/0186252 A1* 8/2006 Kitazawa ..... B60R 22/36 242/382
2006/0214043 A1* 9/2006 Nomura ..... B60R 22/3413 242/374
2008/0210802 A1* 9/2008 Sumiyashiki ..... B60R 22/405 242/379.1
2008/0277851 A1* 11/2008 Genta ..... B41J 15/042 269/56
2009/0057466 A1* 3/2009 Choi ..... B60R 22/3413 242/377
2011/0127363 A1* 6/2011 Tatsuma ..... B60R 22/405 242/383.2
2013/0291790 A1* 11/2013 Tanaka ..... B41F 17/10 118/40
2015/0224958 A1* 8/2015 Lee ..... B60R 22/405 242/382
2015/0224959 A1* 8/2015 Suminaka ..... B60R 22/4633 242/383.4

FOREIGN PATENT DOCUMENTS

JP 2007-261754 A 10/2007
JP 2009-285964 A 12/2009

* cited by examiner

[FIG. 1]
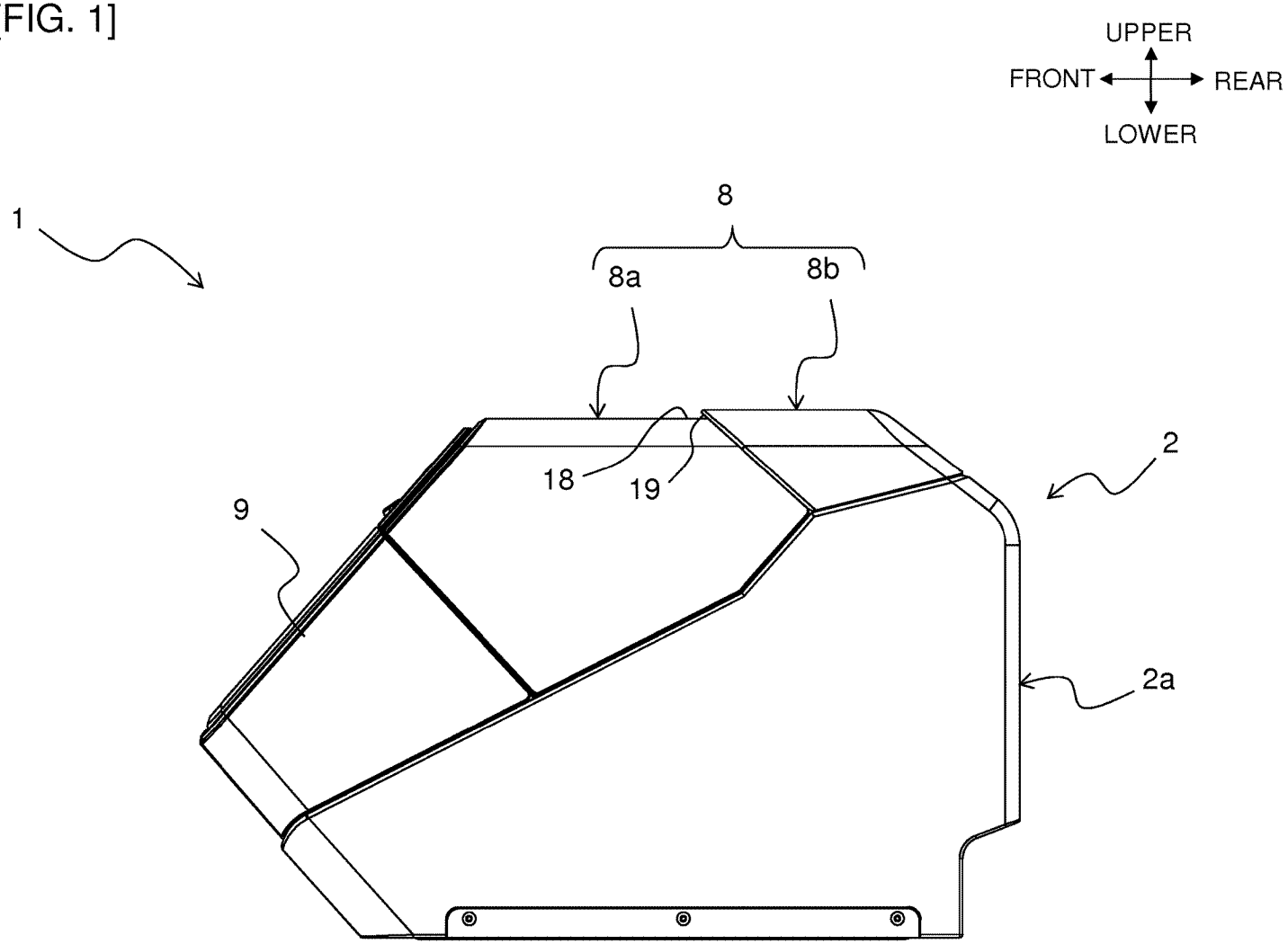

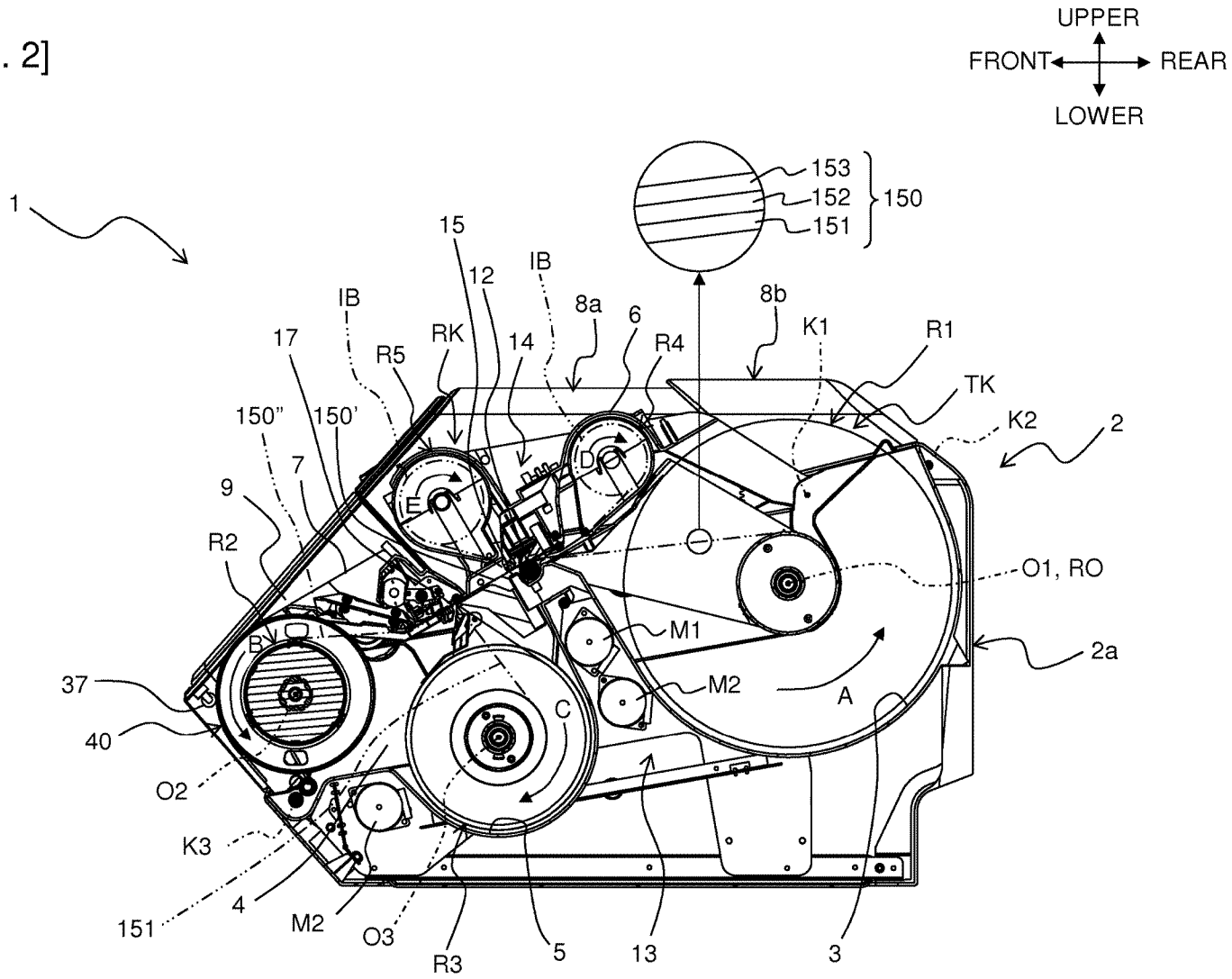
[FIG. 2]

[FIG. 3]
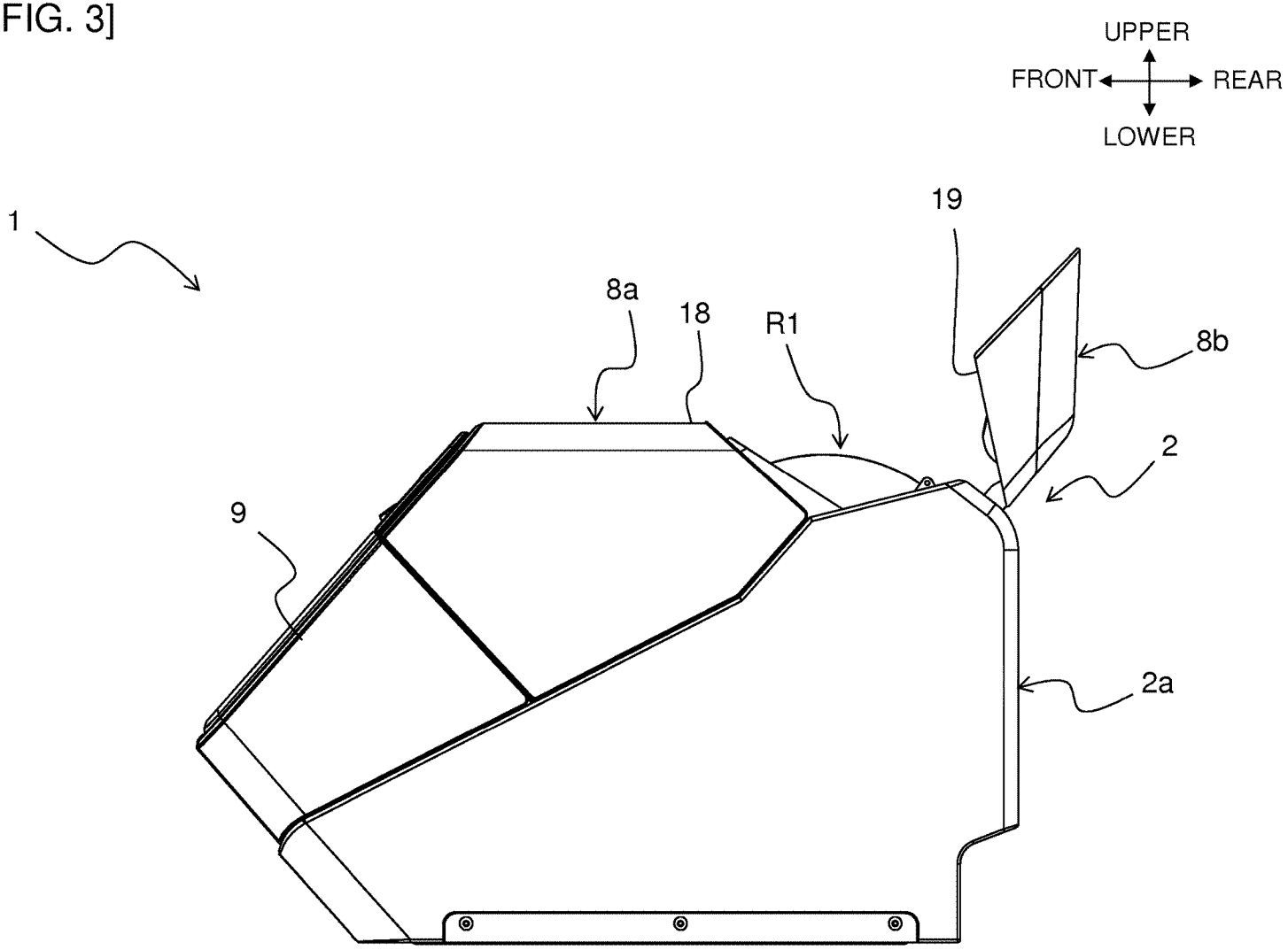

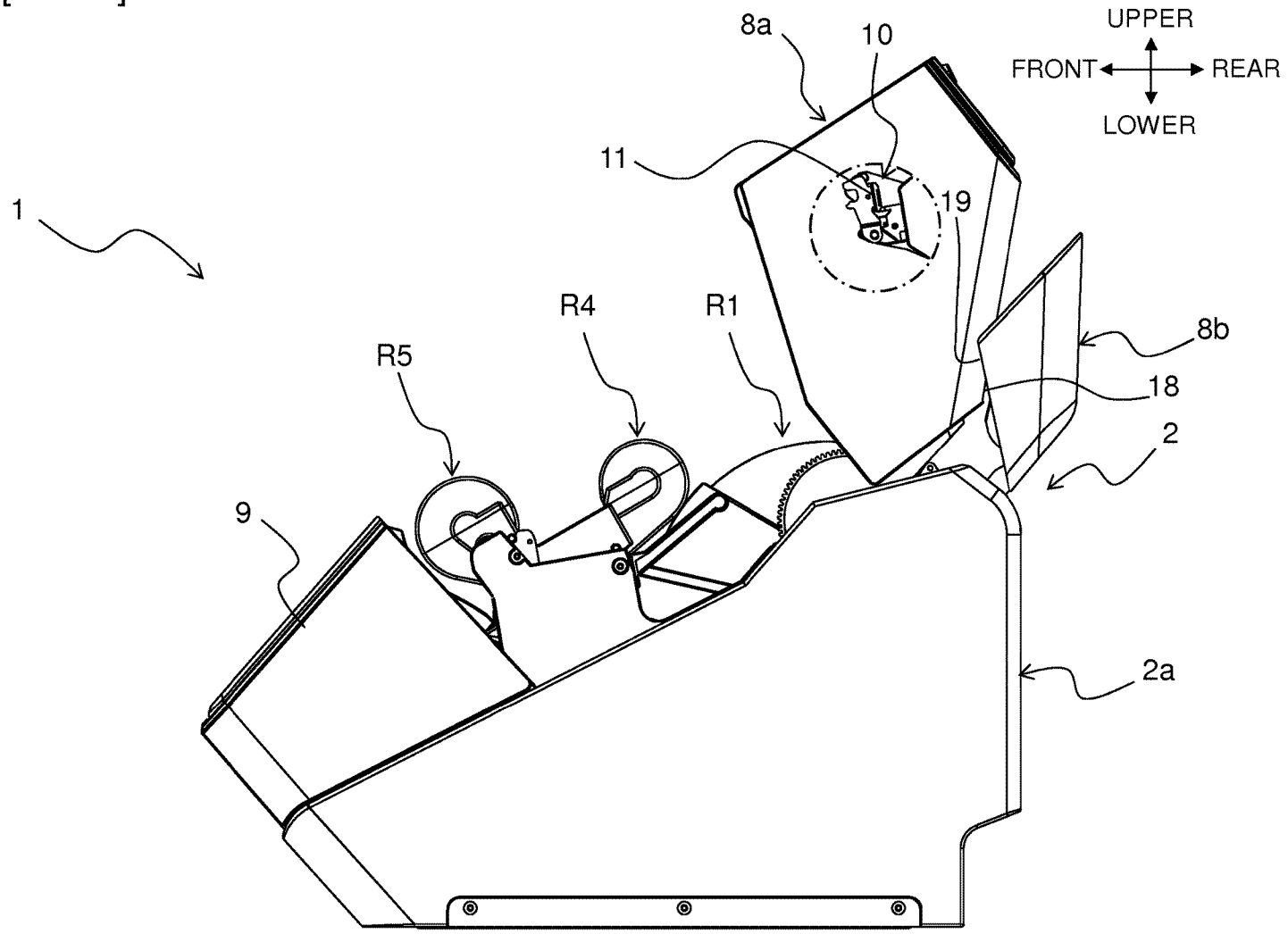
[FIG. 4]

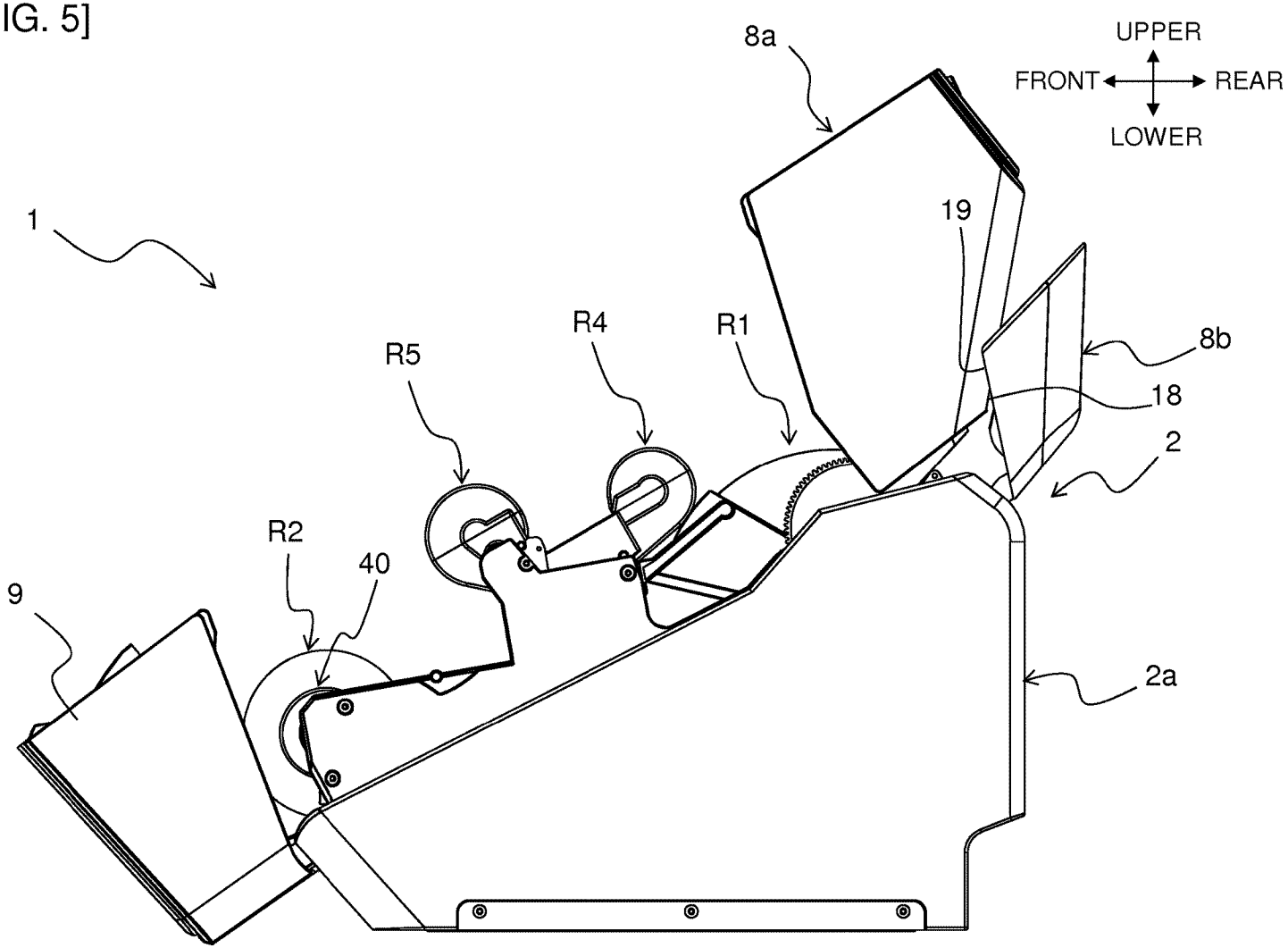
[FIG. 5]

[FIG. 6]
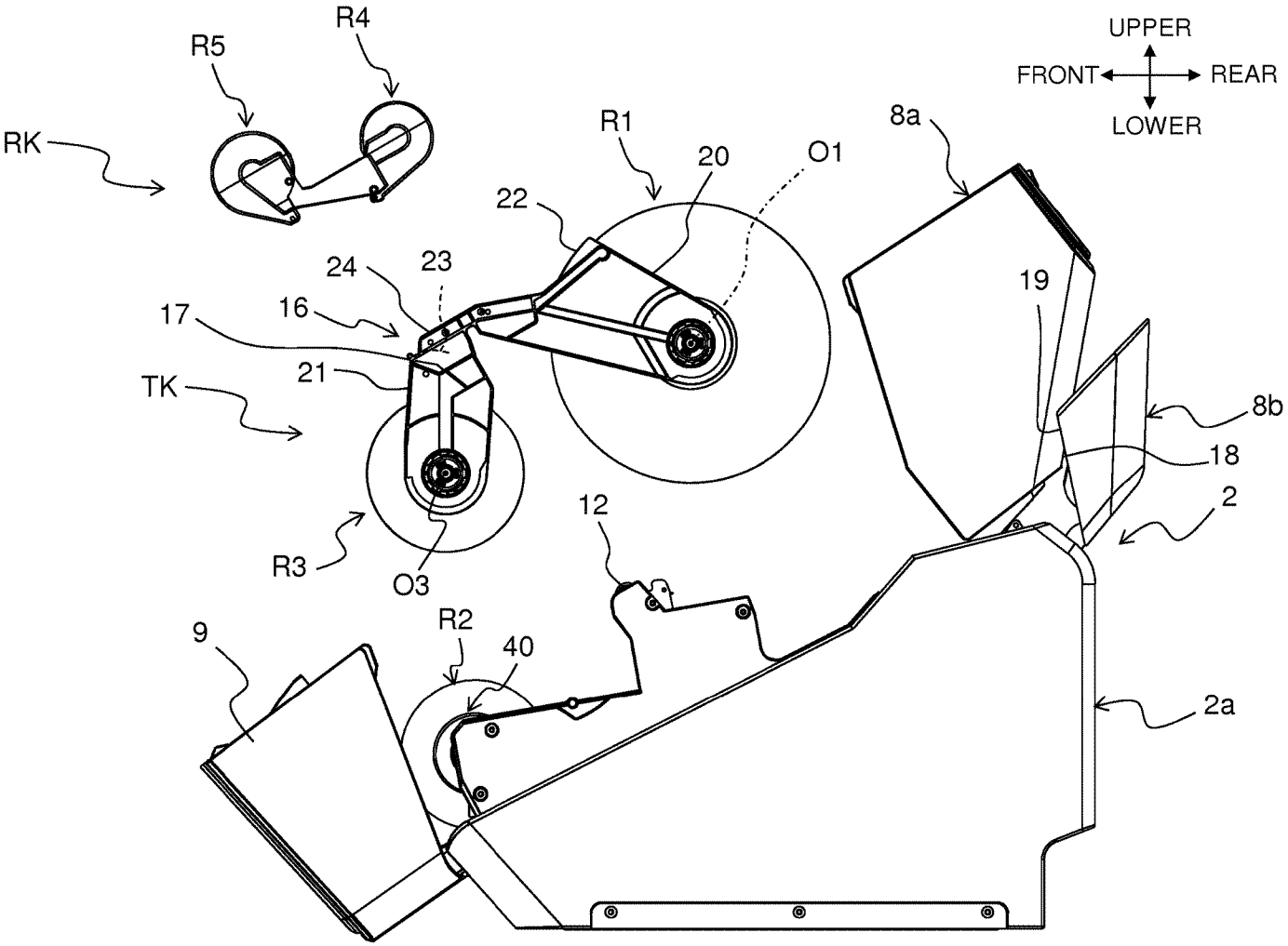

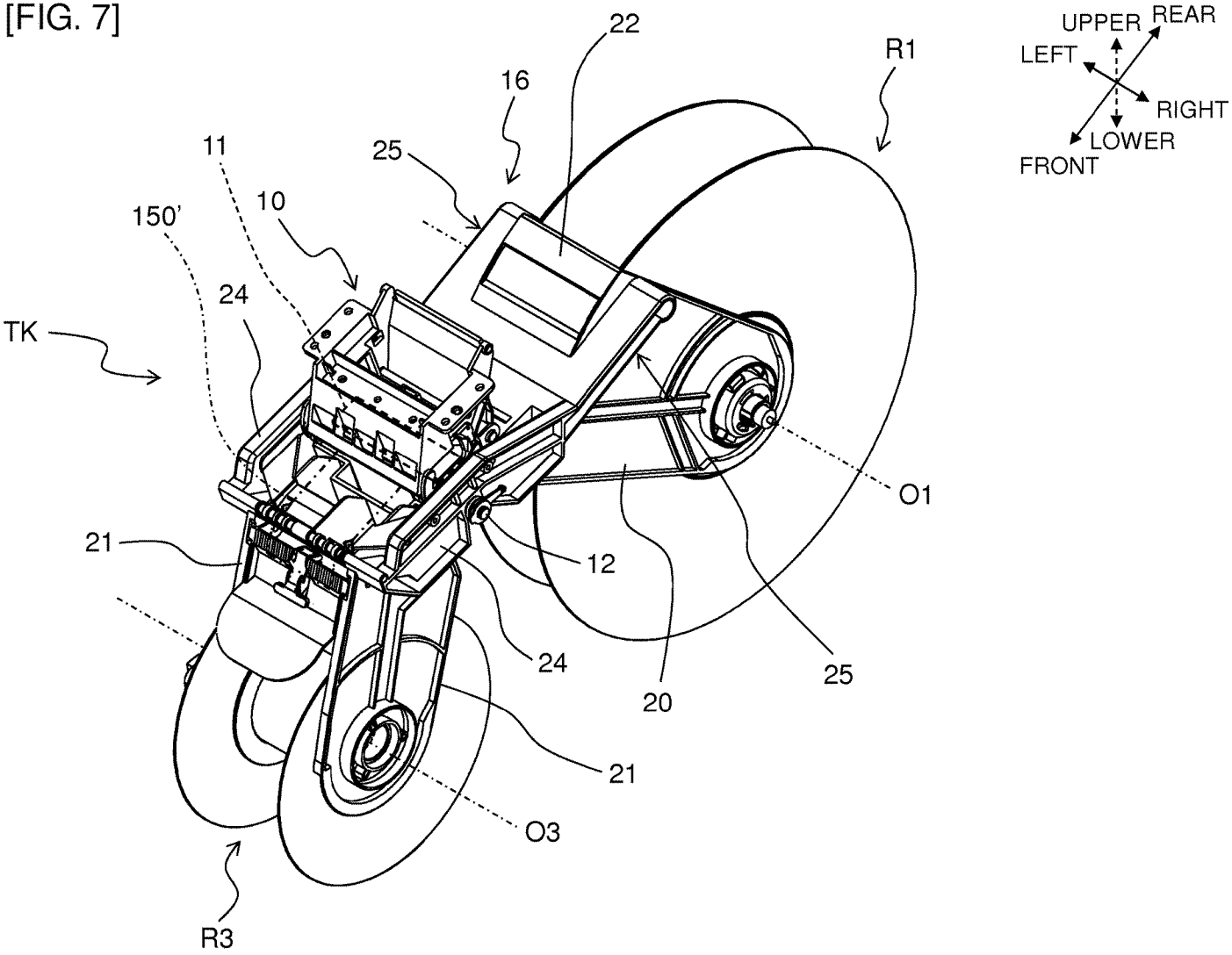
[FIG. 7]

[FIG. 8A]
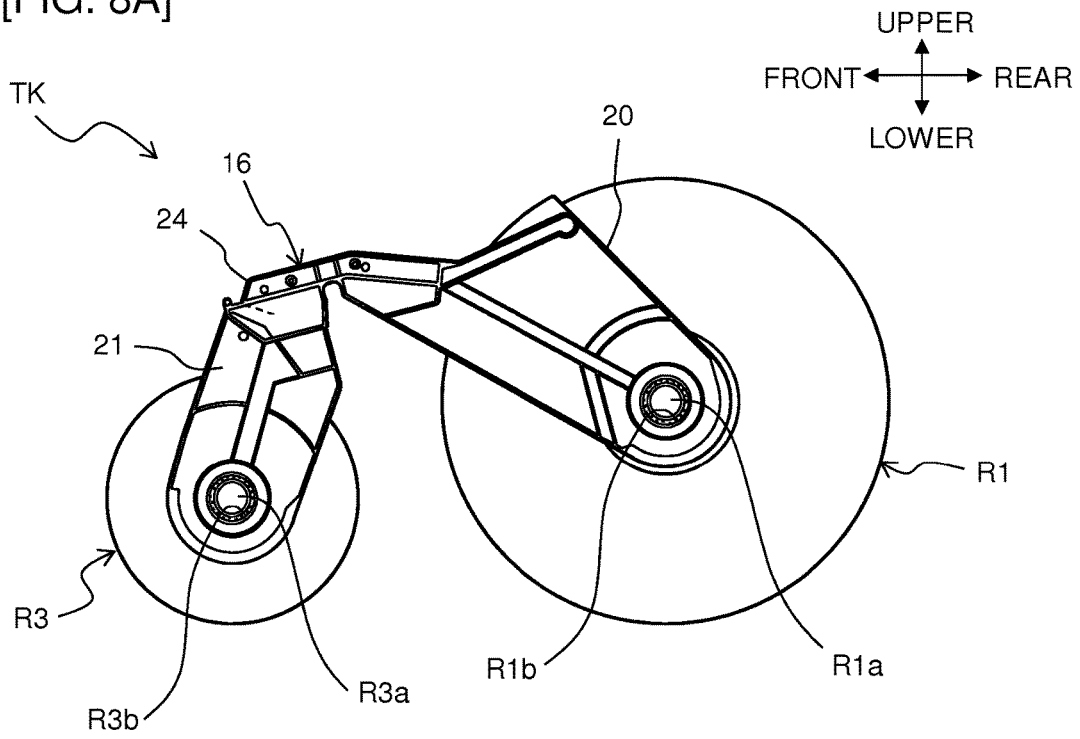
[FIG. 8B]
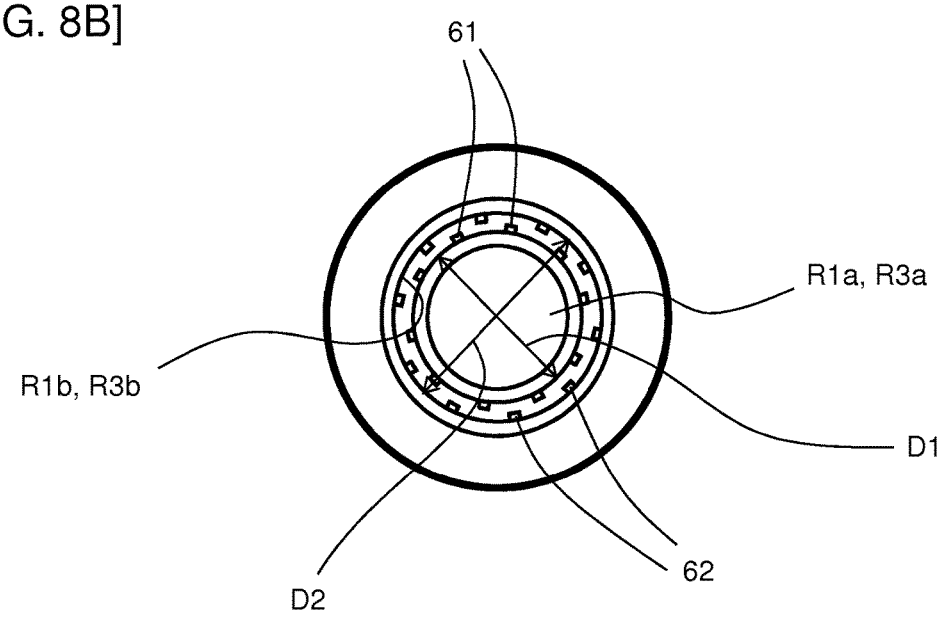

[FIG. 9A]
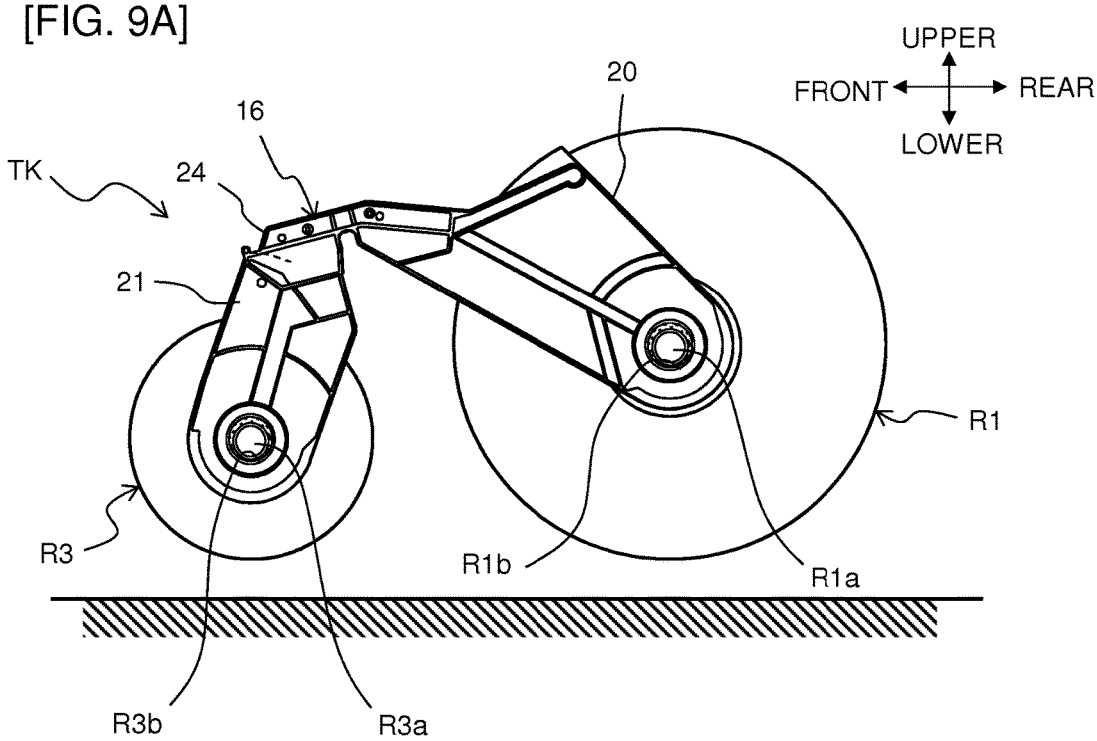
[FIG. 9B]
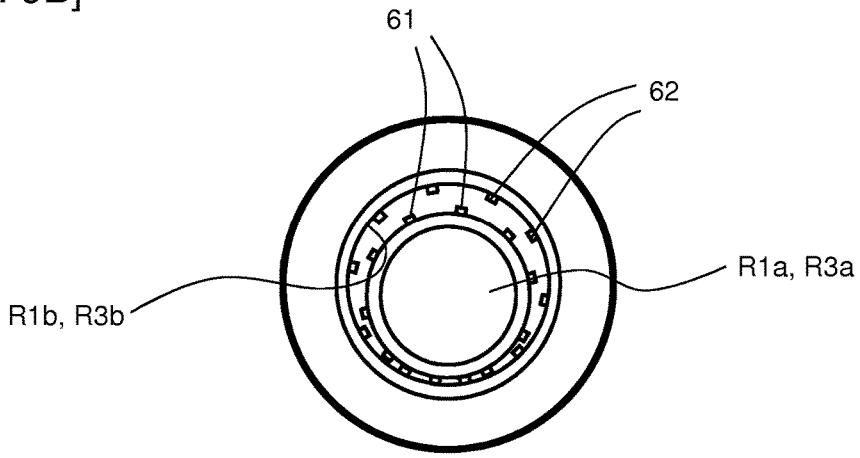

[FIG. 10A]
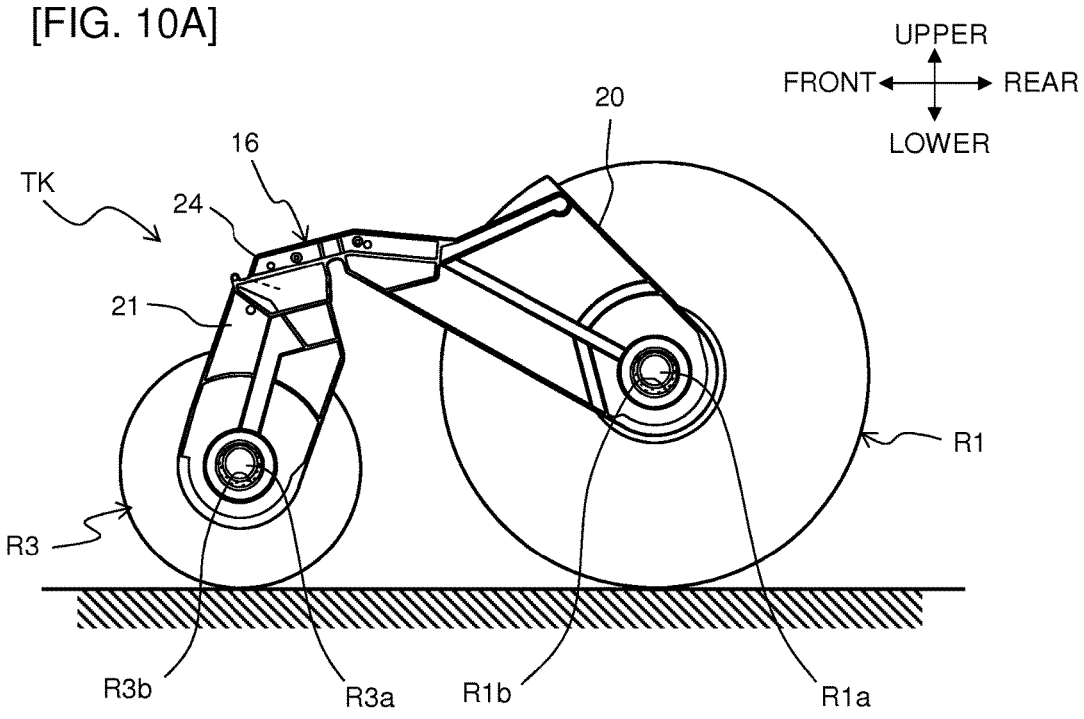
[FIG. 10B]
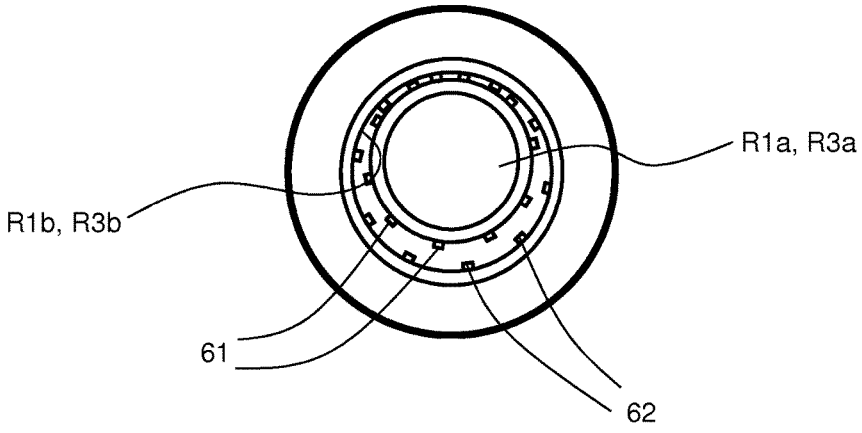

[FIG. 11]
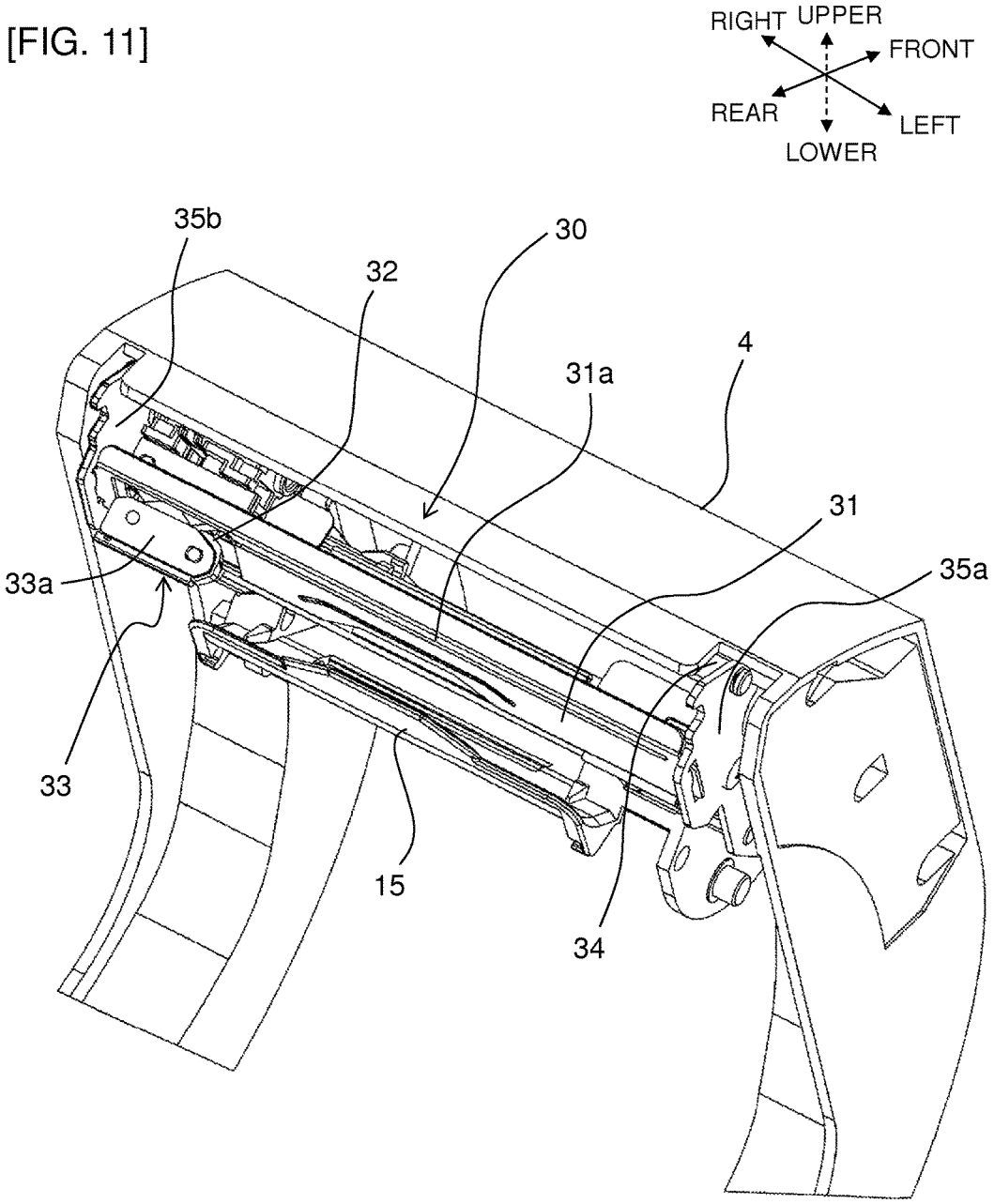

[FIG. 12]
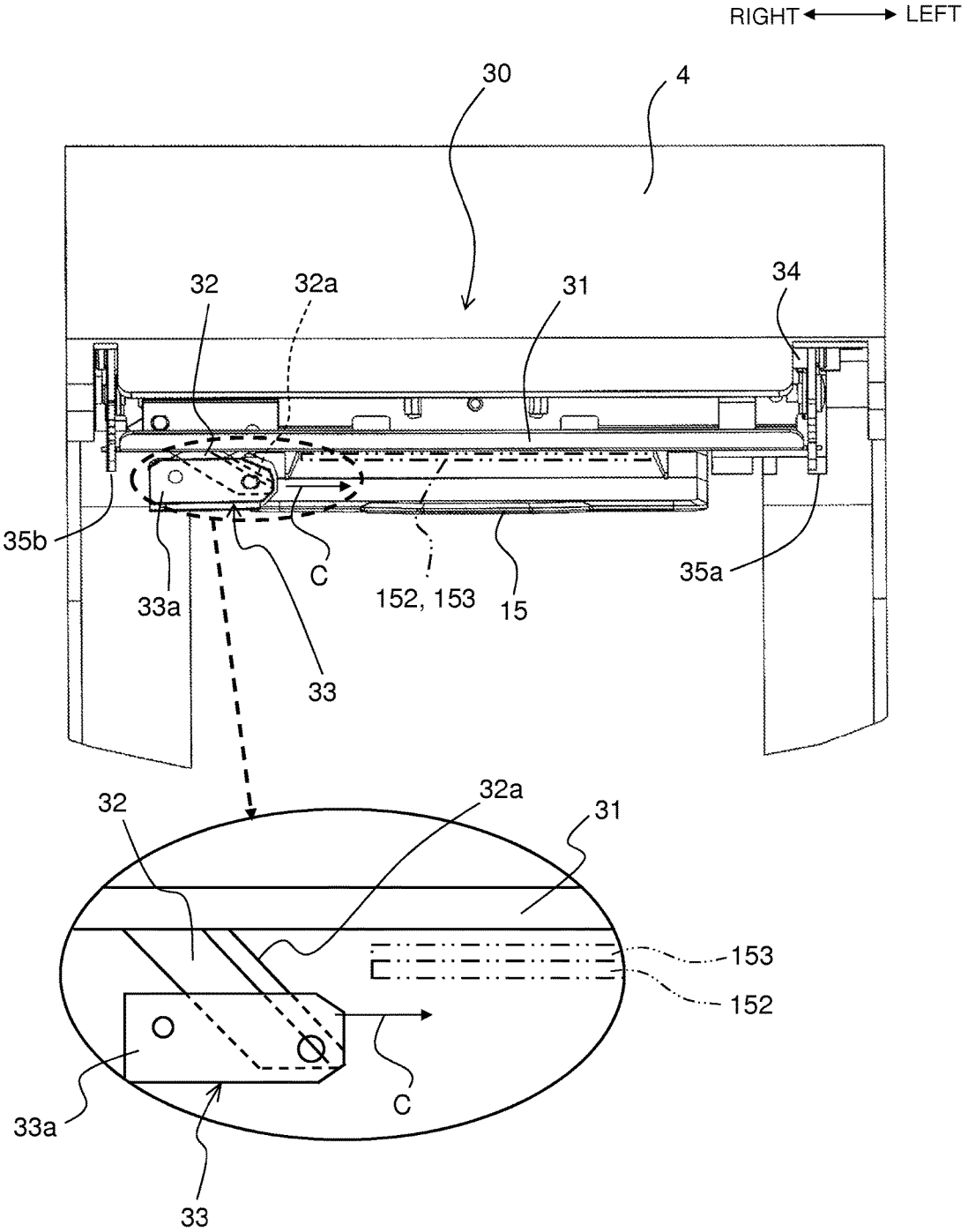

[FIG. 13]
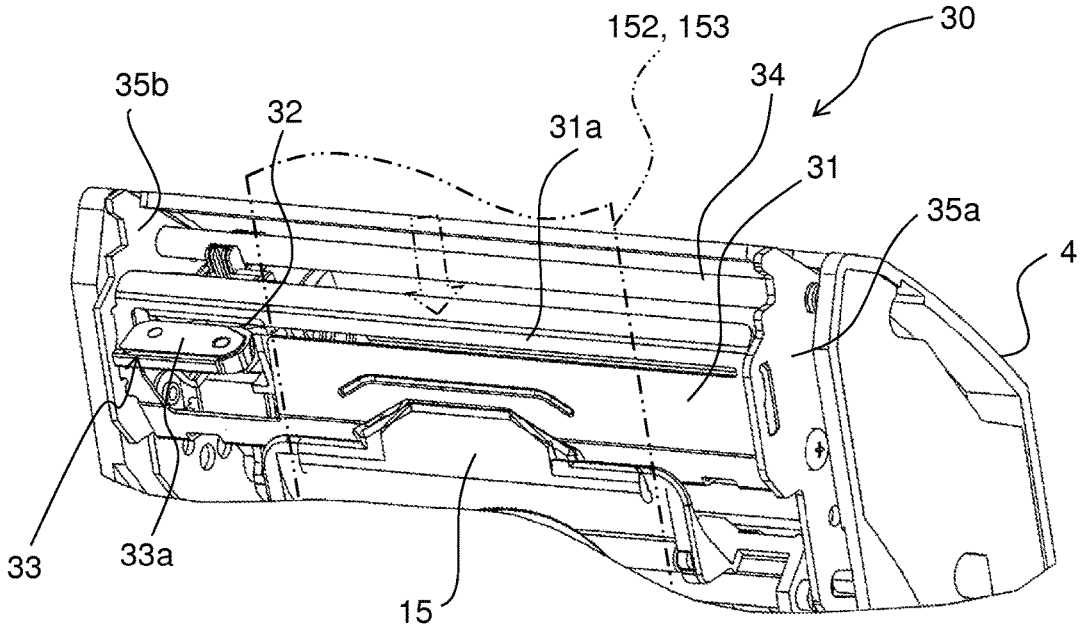

[FIG. 14]
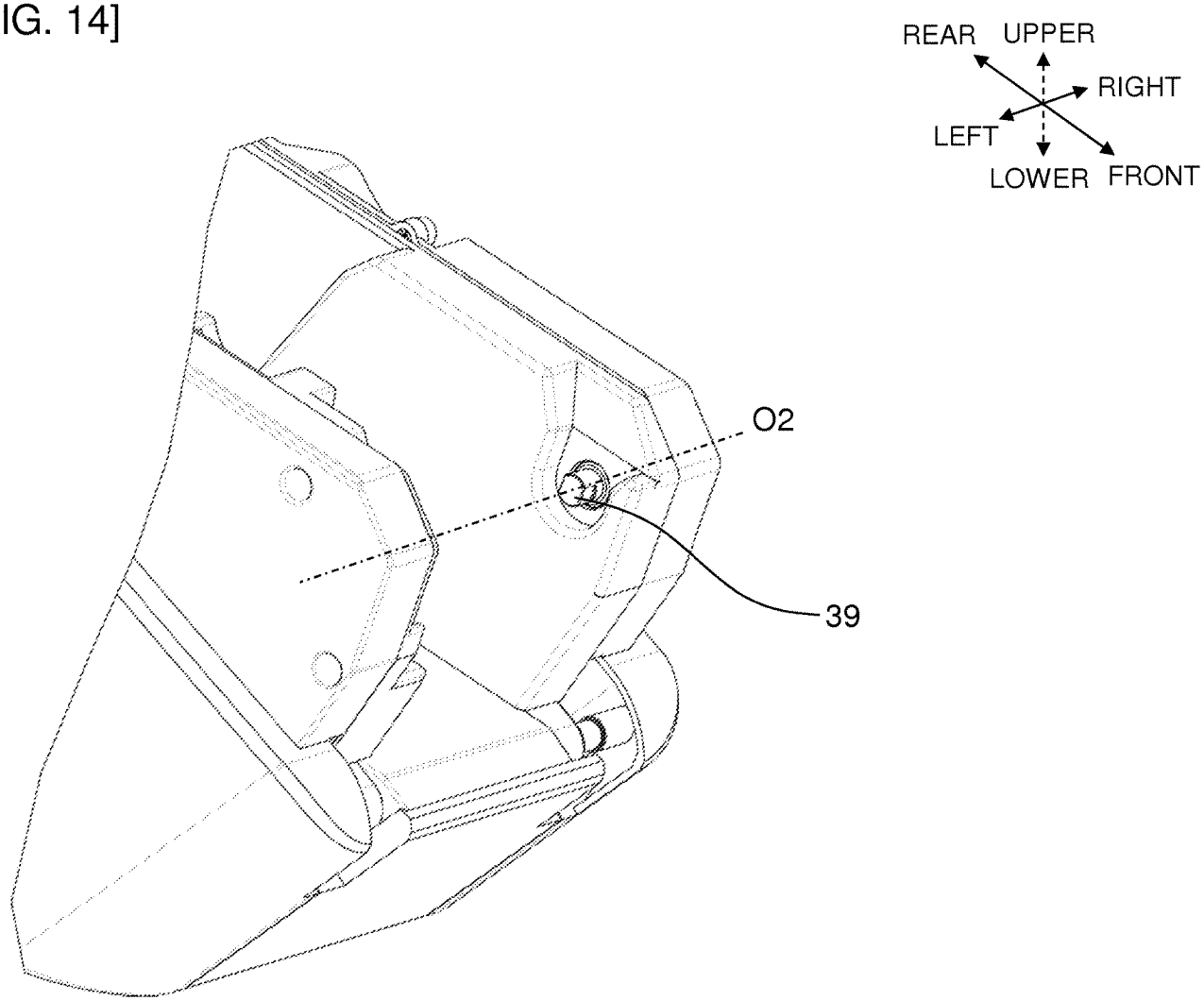

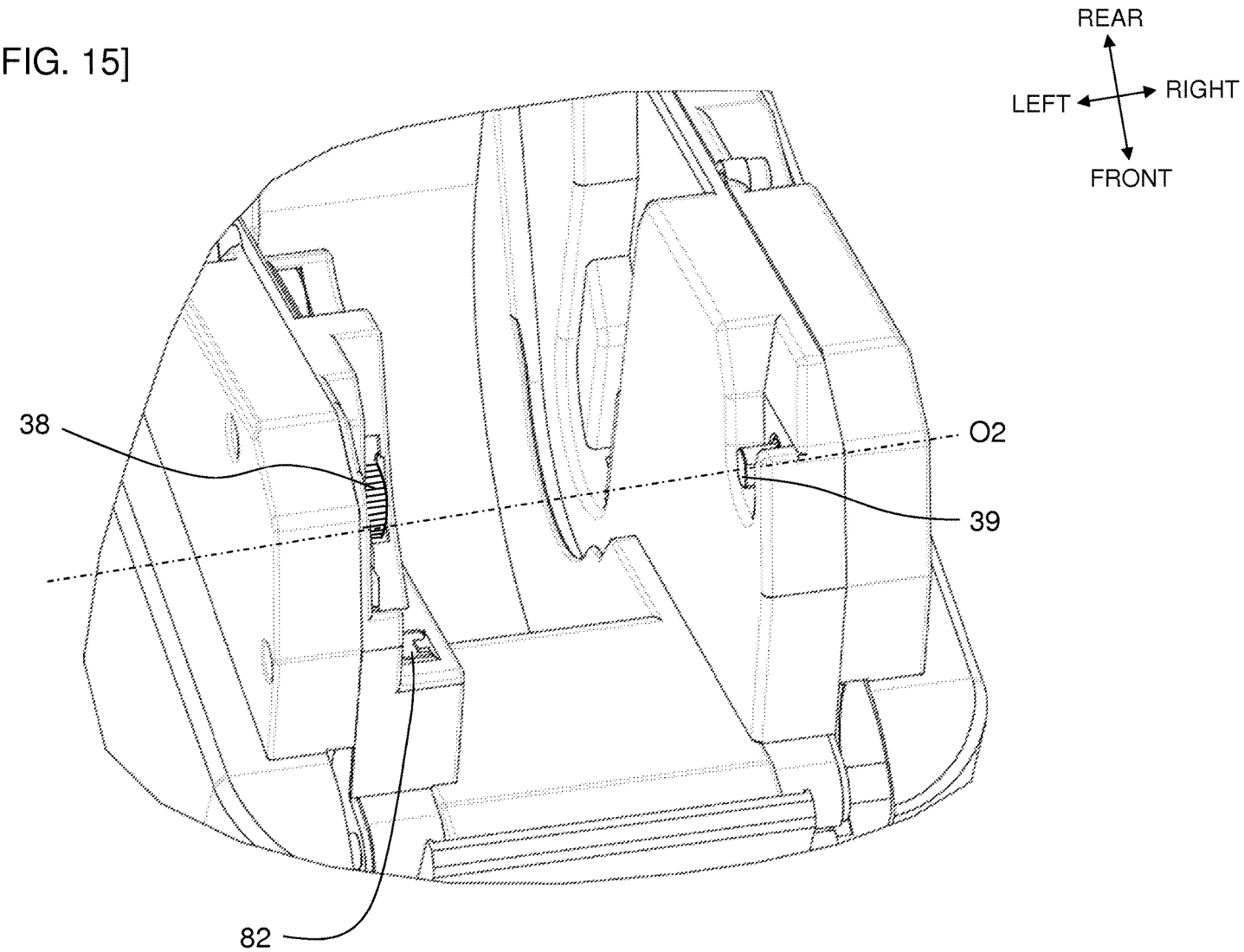
[FIG. 15]

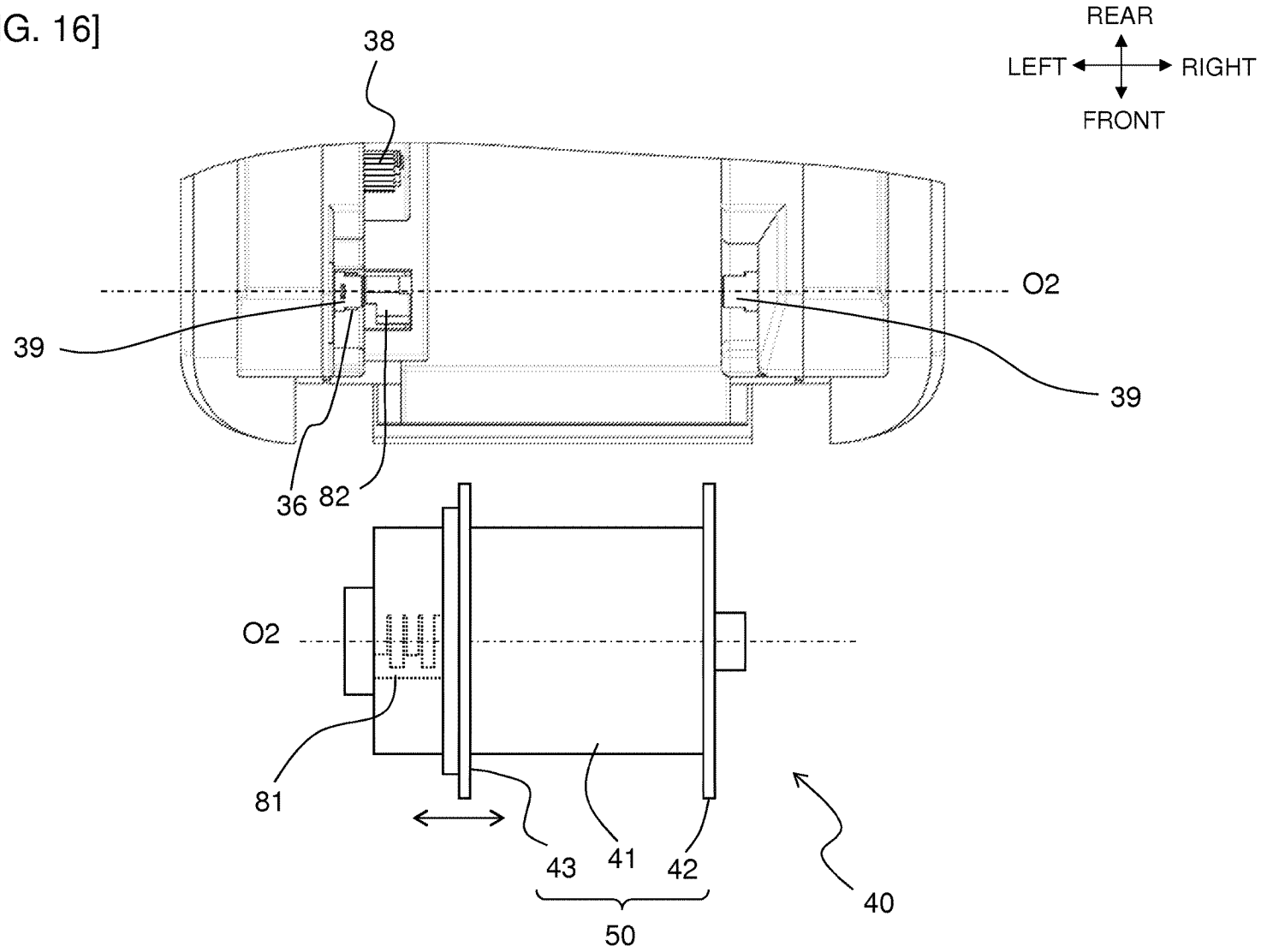
[FIG. 16]

[FIG. 17]
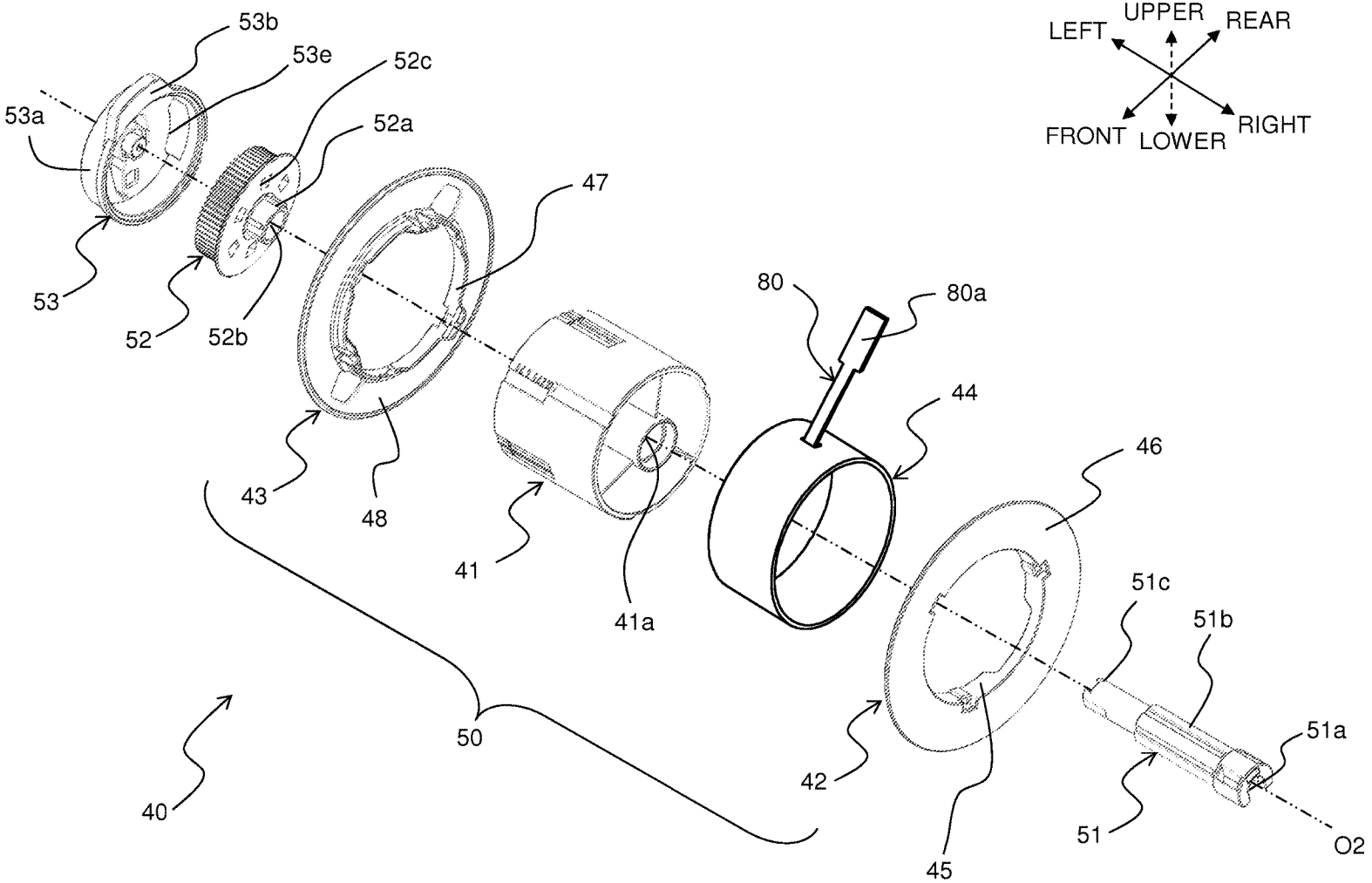

[FIG. 18A]
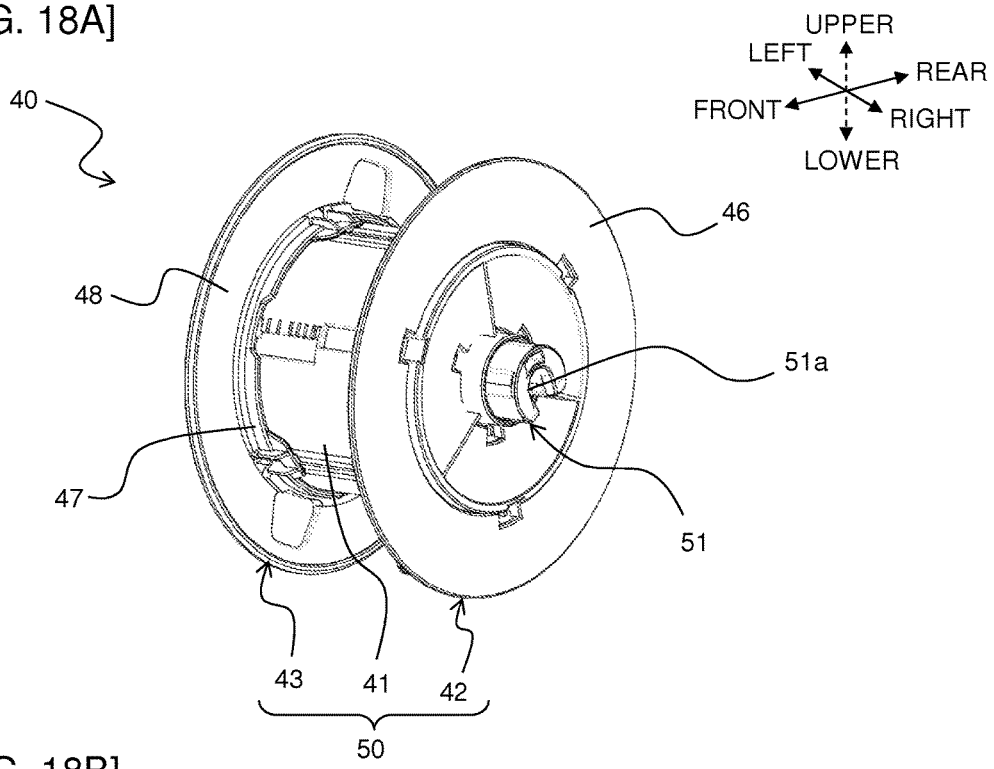
[FIG. 18B]
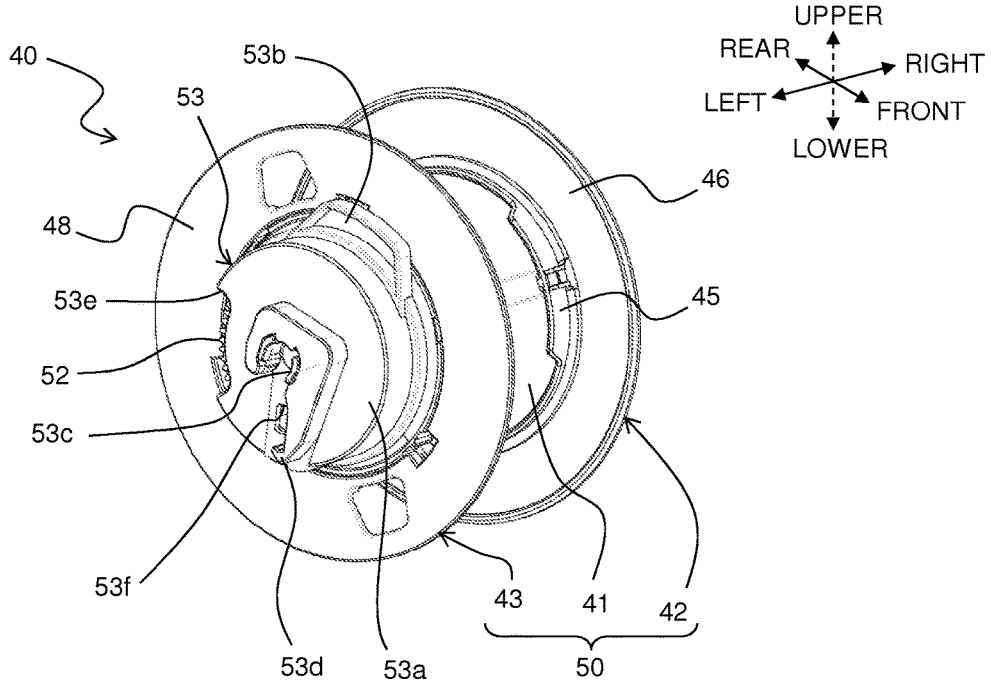

[FIG. 19A]
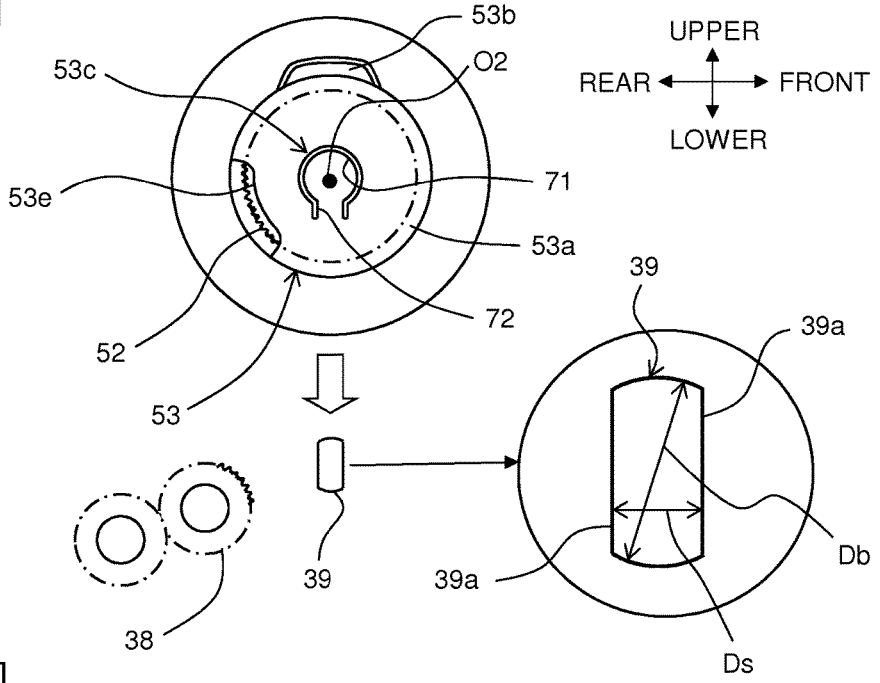
[FIG. 19B]
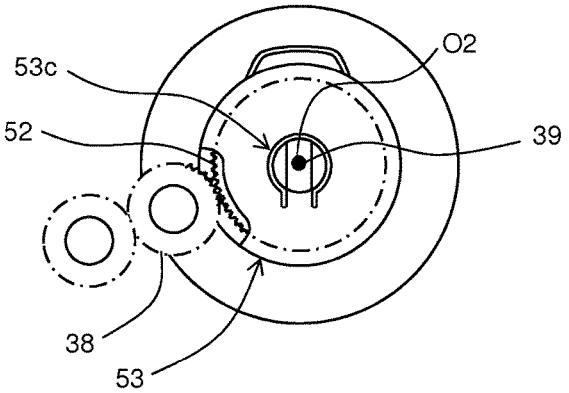
[FIG. 19C]
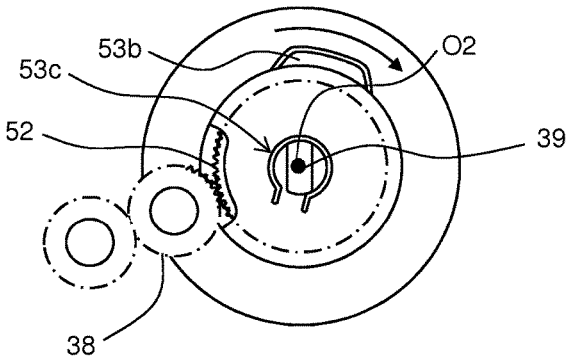

[FIG. 20A]
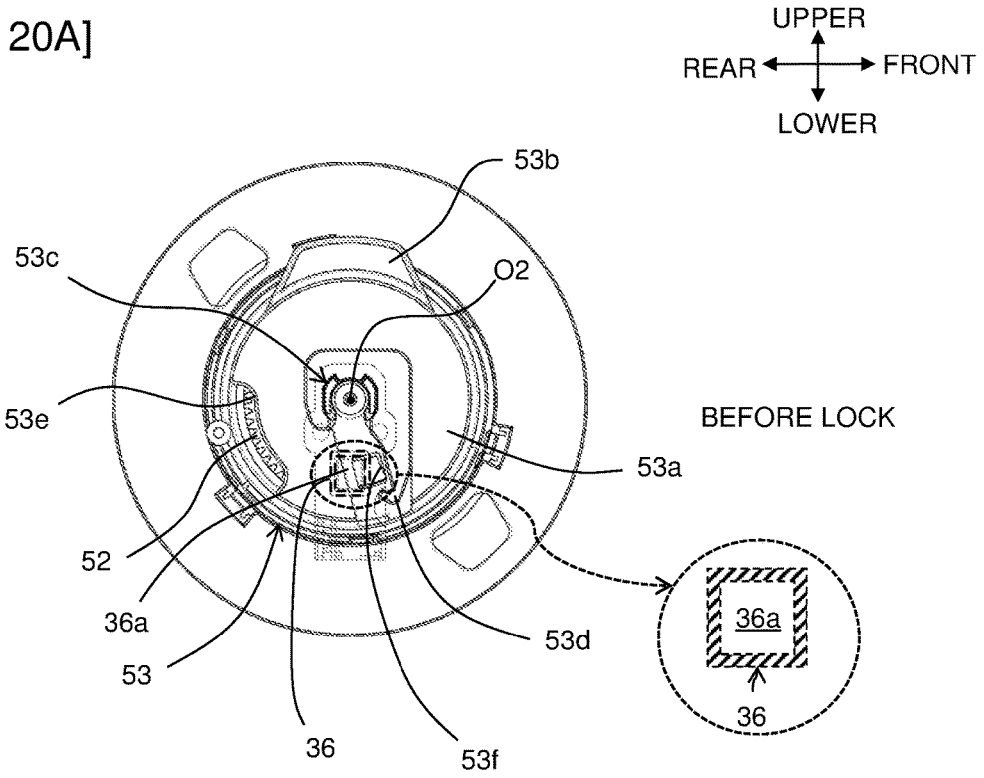
[FIG. 20B]
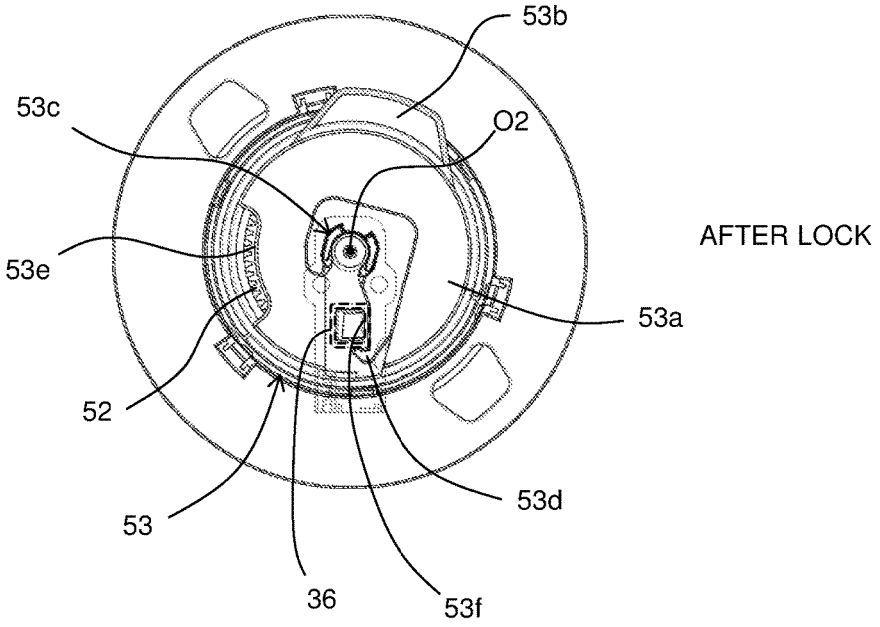

[FIG. 21]
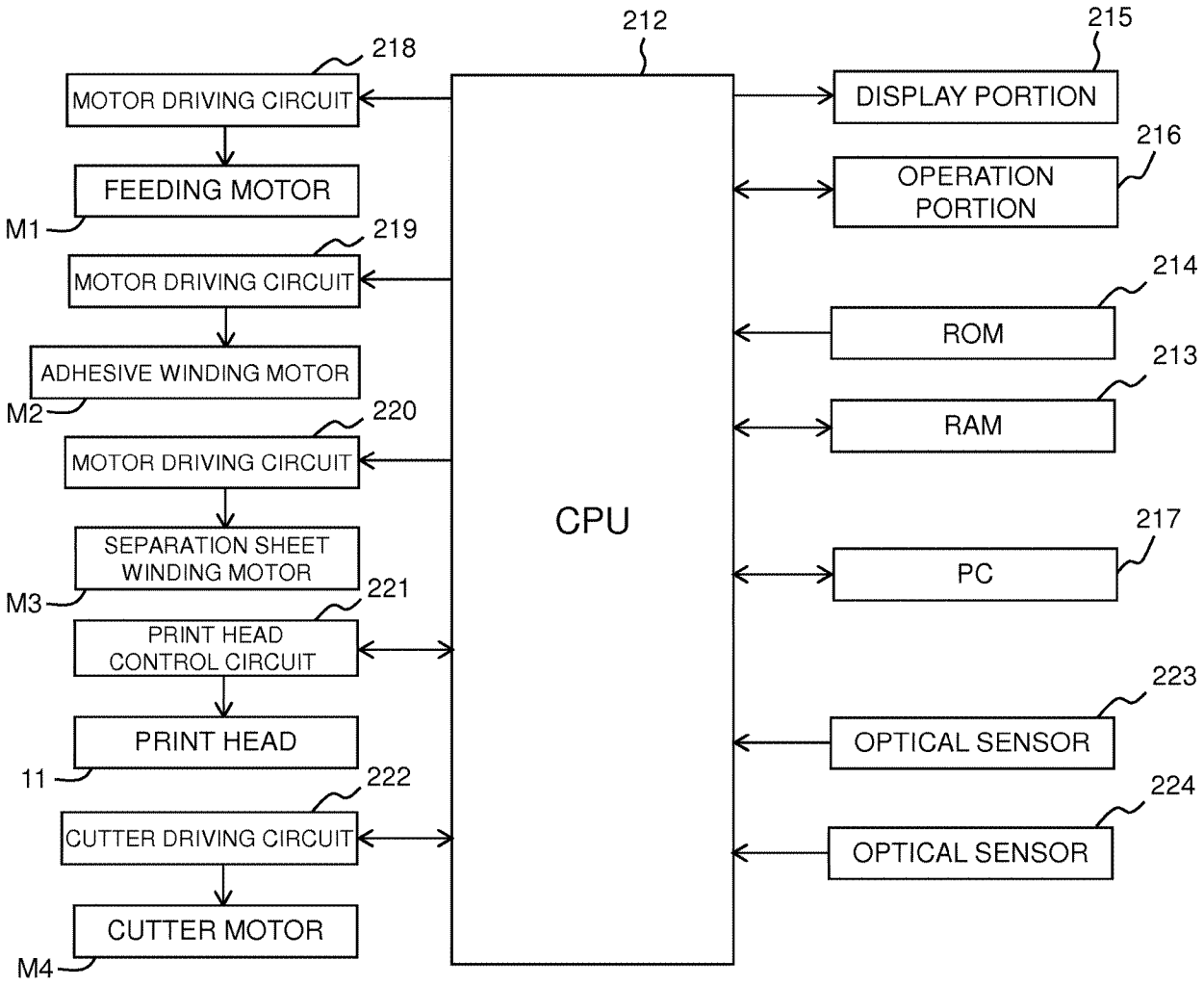

[FIG. 22]
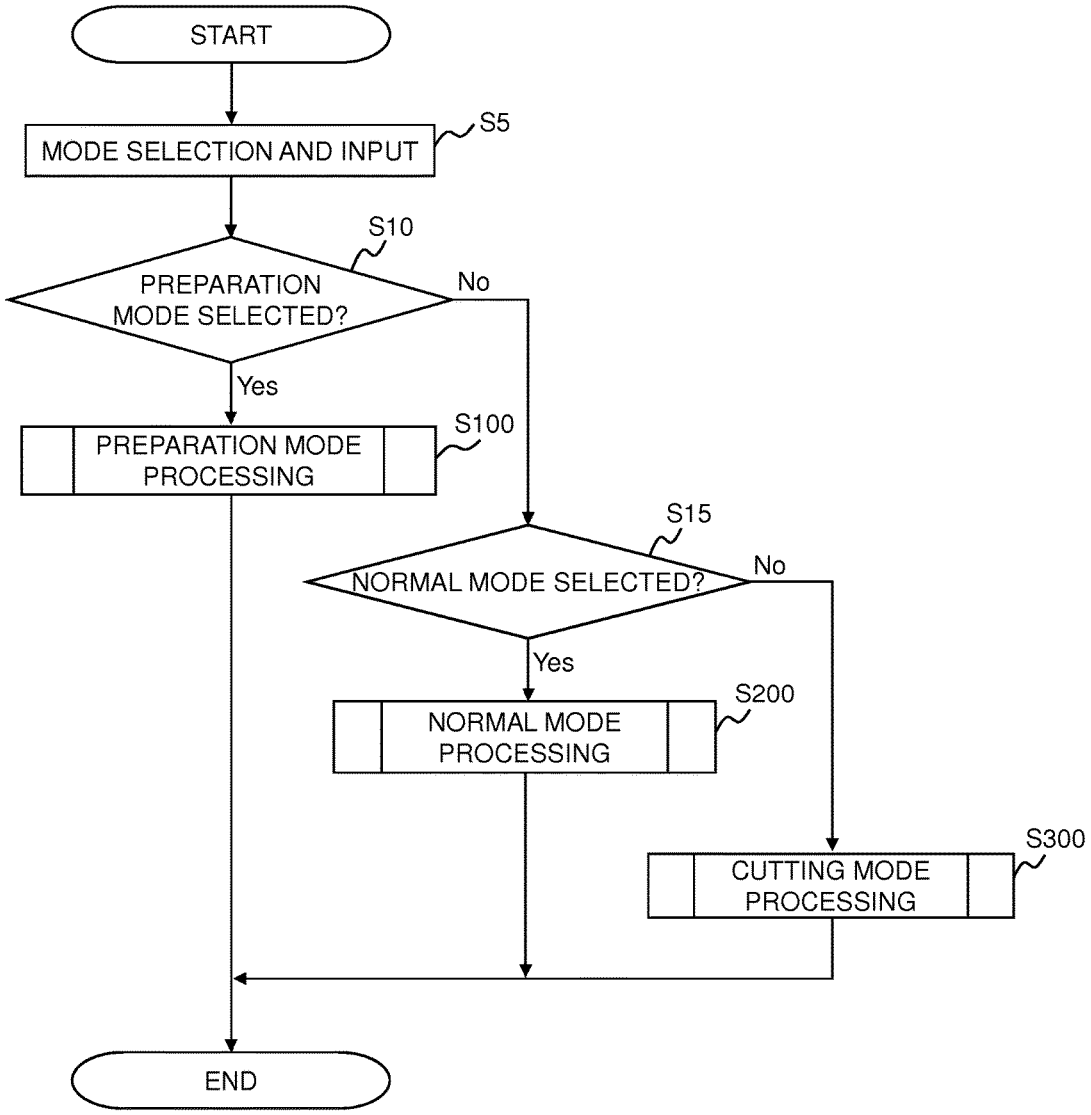

[FIG. 23A]
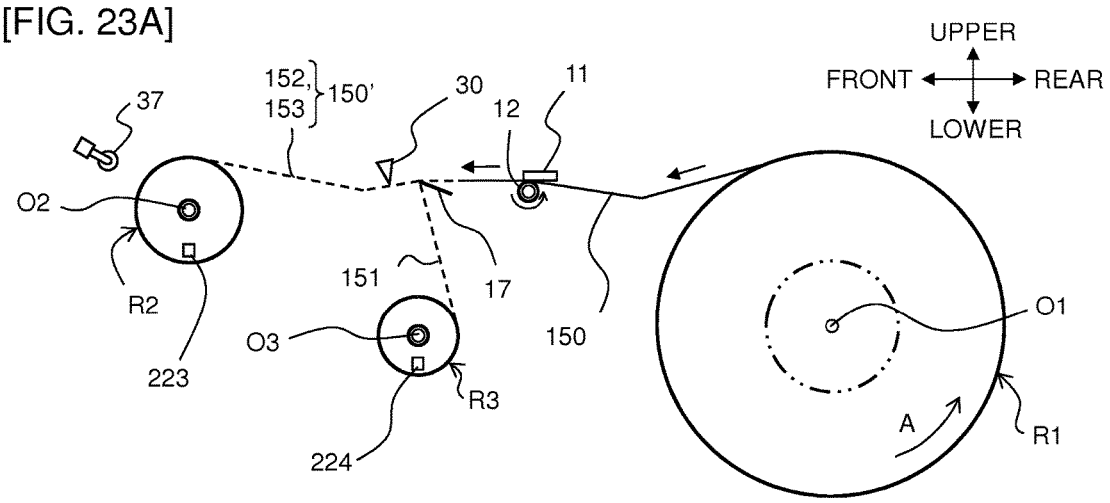
[FIG. 23B]
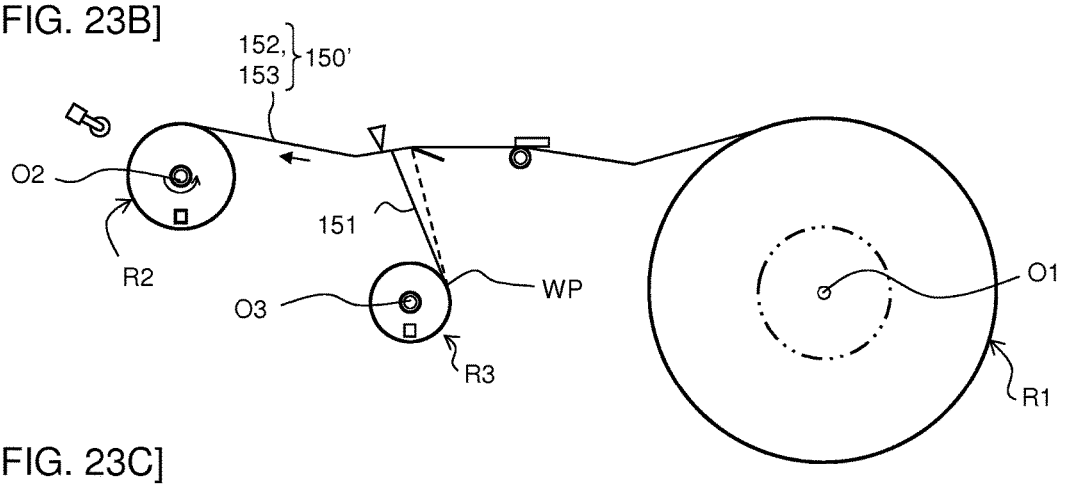
[FIG. 23C]
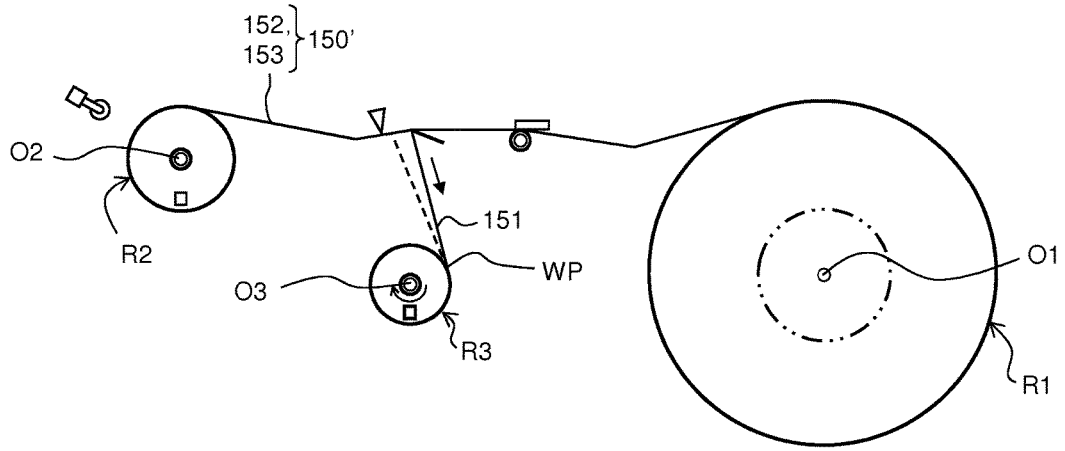

[FIG. 24]
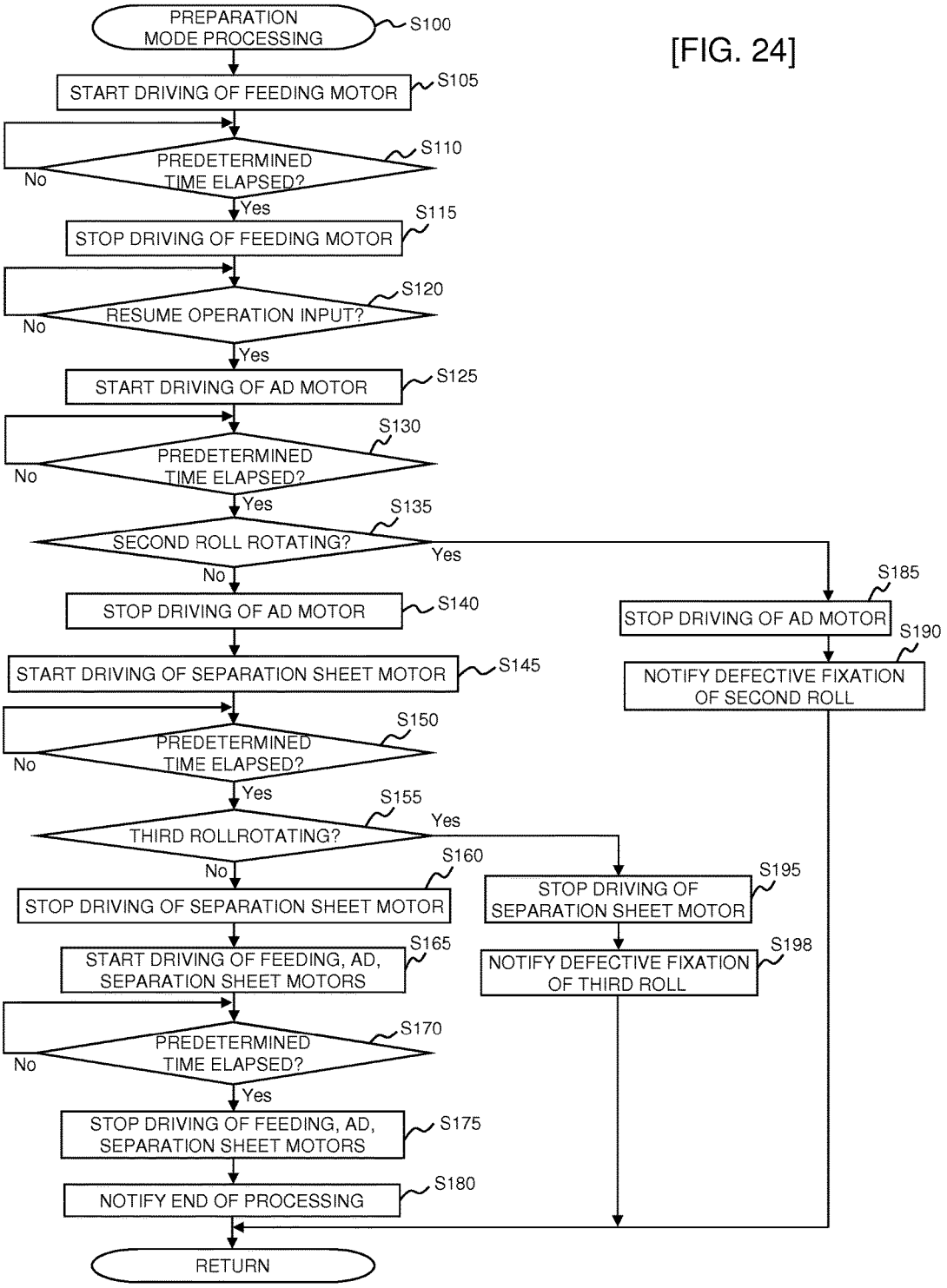

[FIG. 25]
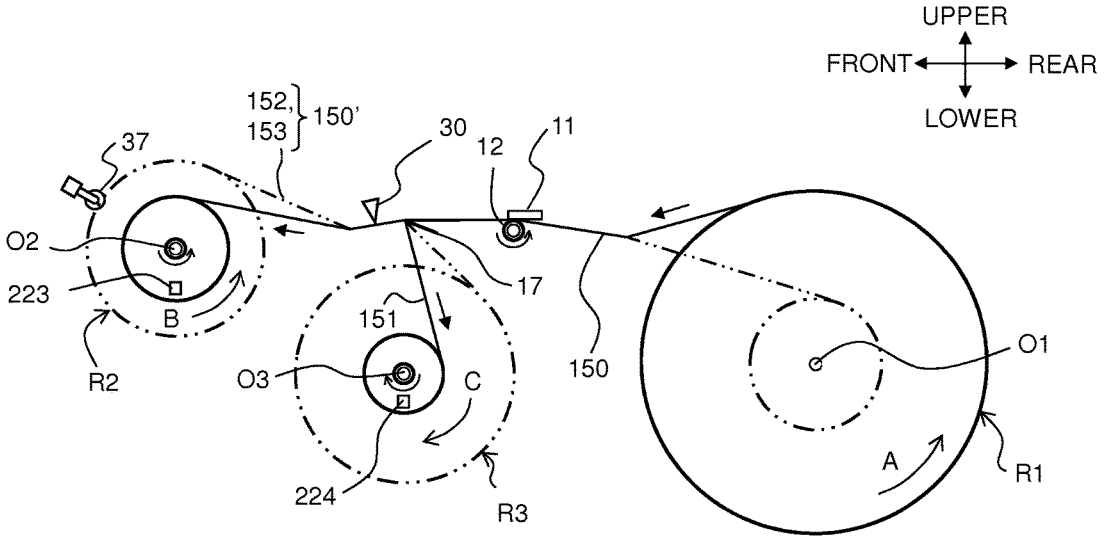

[FIG. 26]
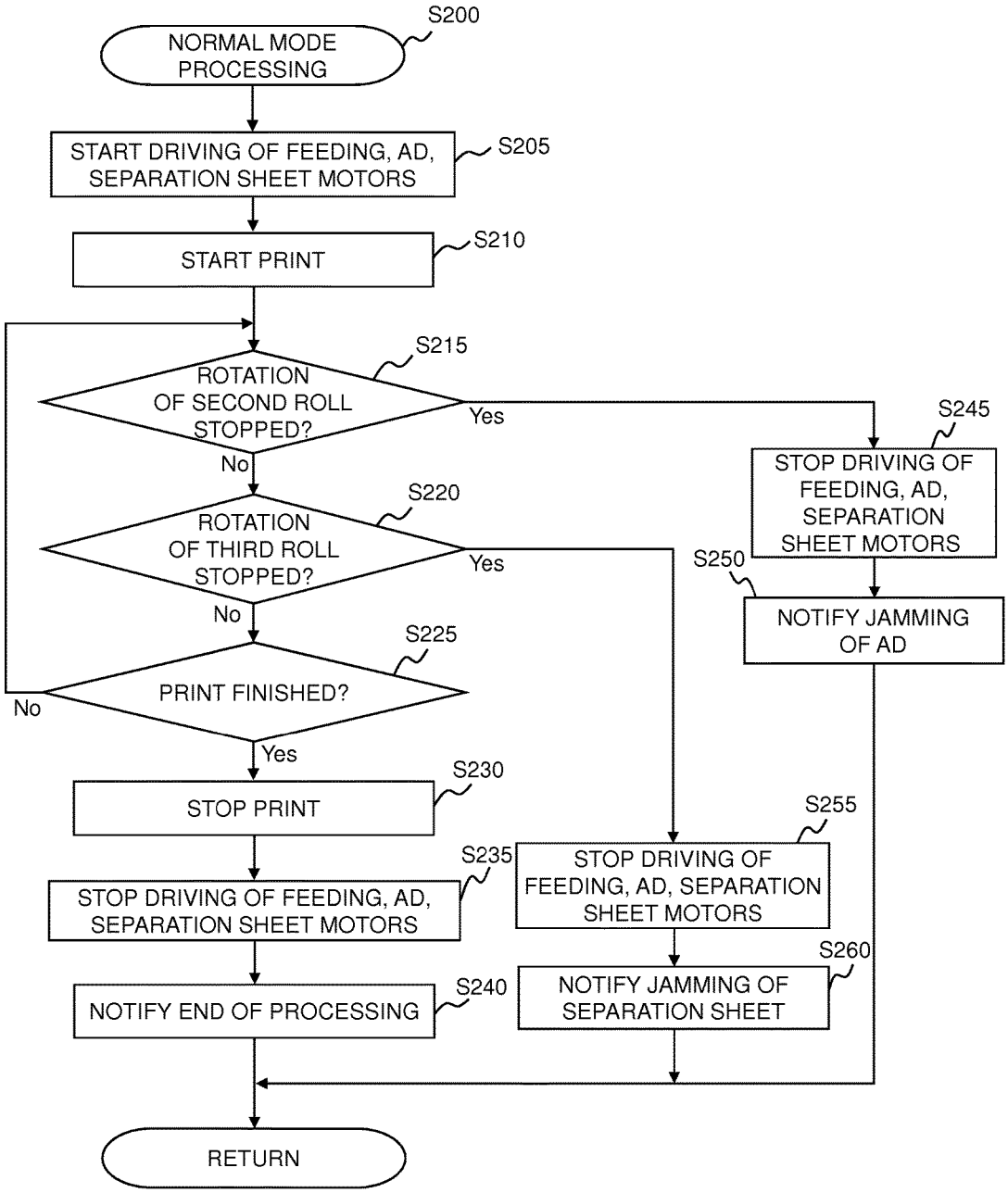

[FIG. 27A]
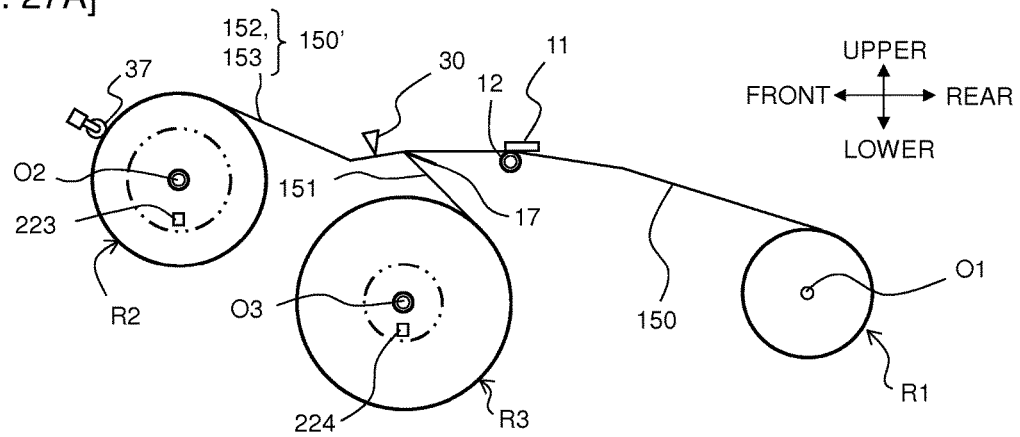
[FIG. 27B]
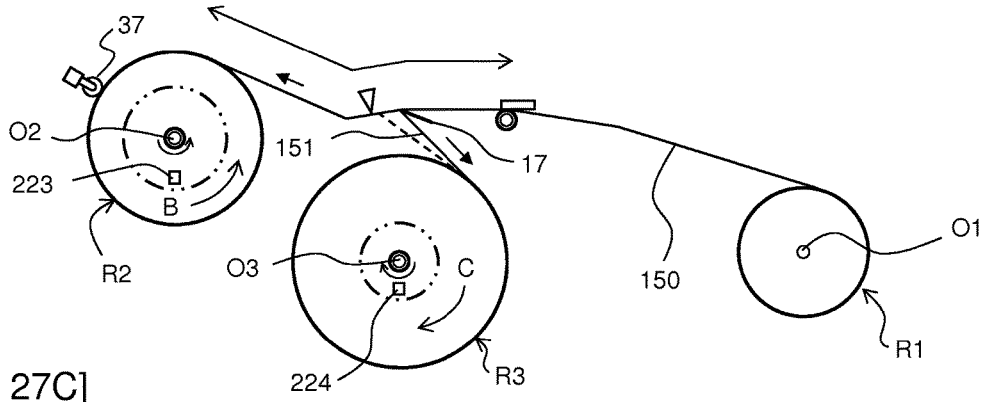
[FIG. 27C]
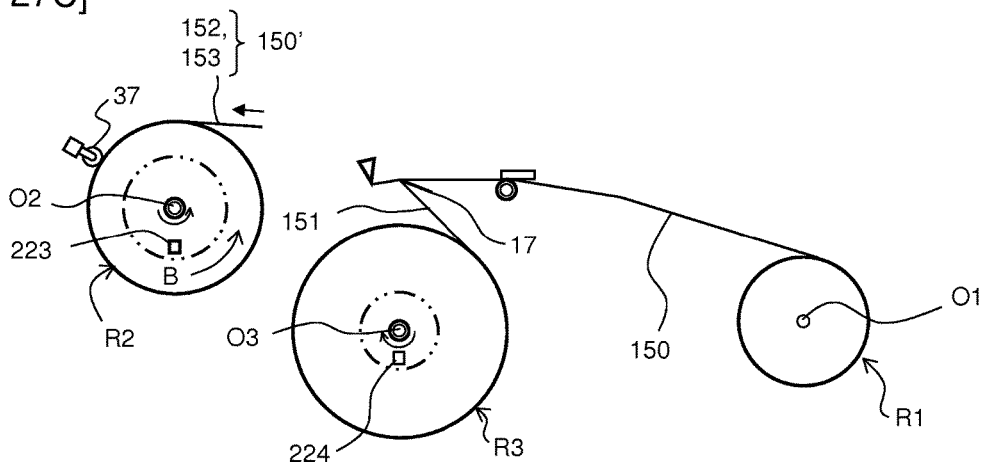

[FIG. 28]
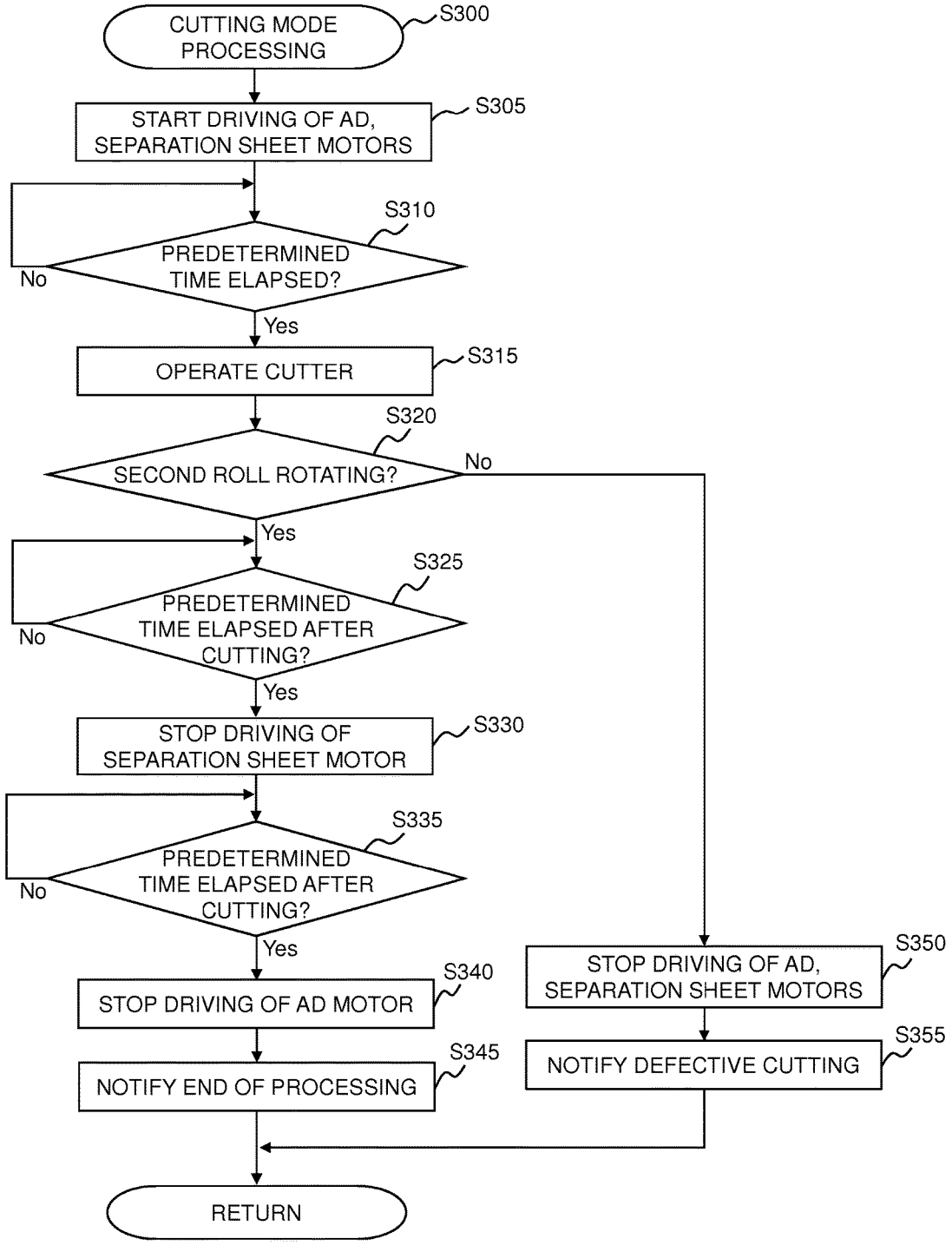

LENGTHY ARTICLE TAKE-UP APPARATUS AND LENGTHY ARTICLE PRINTER

CROSS-REFERENCE TO RELATED APPLICATION

The present application claims priority from Japanese Patent Application No. 2013-17212, which was filed on Jan. 31, 2013, the disclosure of which is incorporated herein by reference in its entirety.

BACKGROUND

Field

The present disclosure relates to a lengthy article take-up apparatus and lengthy article printer.

Description of the Related Art

The prior art discloses a label remover which feeds out a tape on which a large number of labels having an adhesive adhering to a back surface provisionally bonded serially from a roll and which sequentially removes labels one by one from the tape. In a cassette detachably attached to a recess portion of the label remover, a driven side engaging piece of a clutch is provided on one end surface of a take-up shaft winding a start end of the tape fed out of the roll. Moreover, in the label remover, a driving-side engaging piece of the clutch that can be engaged with the driven-side engaging piece of the take-up shaft is provided on one end of a driving shaft driving the take-up shaft.

Attachment of the cassette to the recess portion of this label remover is performed as follows. First, by sliding a slide button by fingers against a spring, a flange provided on the other end of the driving shaft is displaced by its displacing operation, and the driving-side engaging piece of the clutch provided on one end of the driving shaft is pulled into the recess portion. Subsequently, in the pulled-in state, the cassette is arranged into the recess portion. Subsequently, by removing the fingers from the slide button, the driving-side engaging piece of the clutch is engaged with the driven-side engaging piece by extension of the spring, and transmission of power to the take-up shaft in the cassette is enabled.

In the above described prior-art, since it is necessary to slide the slide button against a reaction force by the spring every time the cassette is attached/detached, there is a problem that operability is low. Moreover, a mechanism for advancing/retracting the driving-side engaging piece of the clutch including the spring, the slide button, the flange and the like is necessary, and the structure becomes complicated.

SUMMARY

The present disclosure comprises an object to provide a lengthy article take-up apparatus and lengthy article printer which can improve operability and can simplify the structure while power is reliably transmitted to the take-up shaft.

In order to achieve the above-described object, according to the aspect of the present application, there is provided a lengthy article take-up apparatus configured to wind a lengthy article, comprising a housing constituting an outer shell of the printer, a winding core member detachably attached to the housing and configured to take up the lengthy article, a bearing portion disposed on the housing, and a driving gear disposed on the housing, wherein the winding core member comprises a shaft member configured to be detachably fitted to the bearing portion, a cylindrical winding body disposed rotatably on an outer periphery of the shaft member and configured to wind the lengthy article on an outer peripheral side, a driven gear fixed to the winding body and configured to be meshed with the driving gear when the winding core member is attached to the housing, and a lock member configured to fix the shaft member to the bearing portion when the winding core member is attached to the housing.

In a lengthy article take-up apparatus of the present disclosure, a lengthy article is wound by a winding core member around a winding cylinder. The winding core member has a shaft member, a take-up shaft, a driven gear, and a lock member and is configured to be detachably attached to a housing. The driven gear is meshed with a driving gear disposed on the housing when being attached to the housing of the winding core member. At this time, by fixing the shaft member by the lock member to a bearing portion, the take-up shaft and the driven gear are positioned, and thus, tooth skip in a connection portion between the driving gear and the driven gear can be suppressed. As a result, power of the driving gear can be reliably transmitted to the take-up shaft.

Moreover, in the present disclosure, the lock member which can fix the shaft member to the bearing portion is disposed not on the housing but on the winding core member of the lengthy article take-up apparatus. If the lock member is configured to be disposed on the housing, such a lock mechanism can be considered that by pulling the bearing portion urged by a spring, for example, in a direction of protruding from the housing into the housing by a slide button or the like, by attaching the winding core member in the pulled-in state, and by separating the finger from the slide button after that, the bearing portion is engaged with a bearing member by extension of the spring. In the case of such configuration, every time the winding core member is attached/detached, the slide button needs to be slid against a reaction force by the spring, and operability is low. Particularly, if a force of the spring is made stronger in order to improve a lock function, a force required for a sliding operation increases with that, and the operability is lowered. Thus, the lock function and the operability cannot be both realized. Moreover, an advancing/retracting mechanism of the bearing portion including the spring, the slide button and the like is required, which makes the structure complicated.

In the present disclosure, the lock member is disposed on the winding core member. As a result, such a structure in which the shaft member is made to swing around the shaft core by an operation of the lock member, for example, and the shaft member is fixed to the bearing portion by engagement can be realized. Therefore, since the aforementioned operation against the reaction force of the spring or the like is no longer necessary, operability of the winding core member during attachment/detachment can be improved. That is, since the shaft member can be firmly fixed to the bearing portion with an easy operation, the lock function and operability can be both realized. Moreover, since a mechanism for advancing/retracting the bearing portion including the spring, the slide button and the like is no longer necessary, the structure can be simplified.

BRIEF DESCRIPTION OF THE DRAWING

FIG. 1 is a right side view illustrating an appearance of an adhesive tape printer of an embodiment.

FIG. 2 is a longitudinal sectional view illustrating an internal structure of the adhesive tape printer.

FIG. 3 is a right side view illustrating an appearance of a state in which a second opening/closing cover of the adhesive tape printer is open.

FIG. 4 is a right side view illustrating an appearance of a state in which a first opening/closing cover and the second opening/closing cover of the adhesive tape printer are open.

FIG. 5 is a right side view illustrating an appearance of a state in which the first opening/closing cover, the second opening/closing cover, and a front side opening/closing cover of the adhesive tape printer are open.

FIG. 6 is an exploded side view illustrating a state in which the first opening/closing cover and the second opening/closing cover of the adhesive tape printer are open and an adhesive tape cartridge and a ribbon cartridge are removed.

FIG. 7 is a perspective view illustrating an entire configuration of the adhesive tape cartridge.

FIG. 8A is a view illustrating a support state of each shaft end portion in each shaft hole portion in a state in which the adhesive tape cartridge is attached to a housing body.

FIG. 8B is a view illustrating a support state of each shaft end portion in each shaft hole portion in a state in which the adhesive tape cartridge is attached to a housing body.

FIG. 9A is a view illustrating the support state of each of the shaft end portions in each of the shaft hole portions in a state in which the adhesive tape cartridge is lifted up.

FIG. 9B is a view illustrating the support state of each of the shaft end portions in each of the shaft hole portions in a state in which the adhesive tape cartridge is lifted up.

FIG. 10A is a view illustrating the support state of each of the shaft end portions in each of the shaft hole portions in a state in which the adhesive tape cartridge is placed.

FIG. 10B is a view illustrating the support state of each of the shaft end portions in each of the shaft hole portions in a state in which the adhesive tape cartridge is placed.

FIG. 11 is a perspective view illustrating a cutter mechanism disposed on the front side opening/closing cover.

FIG. 12 is a view illustrating the cutter mechanism.

FIG. 13 is an enlarged view of an essential part in FIG. 11.

FIG. 14 is a perspective view illustrating a structure in a periphery of the bearing portion.

FIG. 15 is a perspective view illustrating the structure in the periphery of the bearing portion.

FIG. 16 is a plan view of the periphery of the bearing portion and the winding core member when seen from above.

FIG. 17 is an exploded perspective view of the winding core member.

FIG. 18A is a perspective view illustrating an appearance of the assembled winding core member.

FIG. 18B is a perspective view illustrating an appearance of the assembled winding core member.

FIG. 19A is a diagram for explaining an attachment configuration of the winding core member with respect to the bearing portion.

FIG. 19B is a diagram for explaining an attachment configuration of the winding core member with respect to the bearing portion.

FIG. 19C is a diagram for explaining an attachment configuration of the winding core member with respect to the bearing portion.

FIG. 20A is a diagram for explaining a locking configuration of a hook portion of the lock member.

FIG. 20B is a diagram for explaining a locking configuration of a hook portion of the lock member.

FIG. 21 is a block diagram illustrating a configuration of a control system of the adhesive tape printer.

FIG. 22 is a flowchart illustrating control contents of printing processing executed by a CPU of the adhesive tape printer.

FIG. 23A is a diagram for explaining control contents of preparation mode processing.

FIG. 23B is a diagram for explaining control contents of preparation mode processing.

FIG. 23C is a diagram for explaining control contents of preparation mode processing.

FIG. 24 is a flowchart illustrating the control contents of the preparation mode processing.

FIG. 25 is a diagram for explaining control contents of normal mode processing.

FIG. 26 is a flowchart illustrating the control contents of the normal mode processing.

FIG. 27A is a diagram for explaining control contents of cutting mode processing.

FIG. 27B is a diagram for explaining control contents of cutting mode processing.

FIG. 27C is a diagram for explaining control contents of cutting mode processing.

FIG. 28 is a flowchart illustrating the control contents of the cutting mode processing.

DETAILED DESCRIPTION OF THE PREFERRED EMBODIMENTS

An embodiment of the present disclosure will be described below by referring to the attached drawings. If "front", "rear", "left", "right", "upper", and "lower" are noted in the drawings, the "front", "rear", "left", "right", "upper", and "lower" in the description indicate the noted directions.

<Outline Configuration of Adhesive Tape Printer>

First, an outline configuration of an adhesive tape printer of the present embodiment will be described by referring to FIGS. 1 to 6.

In FIGS. 1 to 6, the adhesive tape printer 1 of the present embodiment has a housing 2 constituting an outer shell of the apparatus, a rear opening/closing portion 8, and a front opening/closing cover 9.

The housing 2 is provided with a housing body 2*a*, a first accommodating portion 3 disposed on the rear side of the housing body 2*a*, and a second accommodating portion 4 and a third accommodating portion 5 disposed on the front side of the housing body 2*a*. The first accommodating portion 3, the second accommodating portion 4, and the third accommodating portion 5 will be described later in detail.

The rear opening/closing portion 8 is connected capable of opening/closing to an upper part on the rear side of the housing body 2*a*. This rear opening/closing portion 8 can open/close an upper part of the first accommodating portion 3 by rotationally moving. This rear opening/closing portion 8 is constituted by a first opening/closing cover 8*a* and a second opening/closing cover 8*b*.

The first opening/closing cover 8*a* can open/close the upper part on the front side in the first accommodating portion 3 by rotationally moving around a predetermined rotational movement axis K1 disposed on the upper part on the rear side of the housing body 2*a*. In more detail, the first opening/closing cover 8*a* can rotationally move from a closing position where the upper part on the front side in the first accommodating portion 3 is covered (state in FIGS. 1 to 3) to an open position where the upper part on the front side in the first accommodating portion 3 is exposed (state in FIGS. 4 and 5). At this time, the rotational movement axis K1 of the first opening/closing cover 8*a* has its position in a longitudinal direction located on the rear side of a roll center RO of a first roll R1 which will be described later, accommodated in the first accommodating portion 3 and has a position in a vertical direction located on an upper side of the roll center RO.

Inside the first opening/closing cover 8*a*, a head holding body 10 is disposed (See FIG. 4). The first opening/closing cover 8*a* can relatively bring/separate a print head 11 provided on the head holding body 10 and which will be described later to/from a feeding roller 12 disposed on the housing body 2*a* and which will be described later by rotationally moving around the above described rotational movement axis K1. In detail, the first opening/closing cover 8*a* can rotationally move from a closed position (state in FIG. 2) where the print head 11 is close to the feeding roller 12 to an open position (state in FIG. 6) where the print head 11 is away from the feeding roller 12.

The second opening/closing cover 8*b* is disposed on the rear side of the above described first opening/closing cover 8*a* and can open/close the upper part on the rear side in the first accommodating portion 3 separately from opening/closing of the above described first opening/closing cover 8*a* by rotationally moving around a predetermined rotational movement axis K2 disposed on an upper end portion on the rear side of the housing body 2*a*. In detail, the second opening/closing cover 8*b* can rotationally move from a closed position (state in FIGS. 1 and 2) covering the upper part on the rear side in the first accommodating portion 3 to an open position (state in FIGS. 3 to 5) exposing the upper part on the rear side in the first accommodating portion 3. At this time, the position of the rotational movement axis K2 of the second opening/closing cover 8*b* in the longitudinal direction is further on the rear side of the rotational movement axis K1 of the above described first opening/closing cover 8*a* and the position in the vertical direction is further on the upper side of the rotational movement axis K1. The position in the vertical direction of the rotational movement axis K2 of the second opening/closing cover 8*b* may be the same as that of the rotational movement axis K1 of the above described first opening/closing cover 8*a*.

When the first opening/closing cover 8*a* and the second opening/closing cover 8*b* are in the closed state, respectively, an outer peripheral portion 18 of the first opening/closing cover 8*a* and an edge portion 19 of the second opening/closing cover 8*b* are configured to be brought into contact with each other and to cover substantially the whole upper part of the first accommodating portion 3.

The front opening/closing cover 9 is connected to an upper part on the front side of the housing body 2*a*, capable of being opened/closed. This front opening/closing cover 9 can open/close an upper part of the second accommodating portion 4 by rotationally moving around a predetermined movement axis K3 disposed on an upper end portion on the front side of the housing body 2*a*. In detail, the front opening/closing cover 9 can rotationally move from a closed position (state in FIGS. 1 to 4) covering the upper part on the second accommodating portion 4 to an open position (state in FIG. 5) exposing the upper part of the second accommodating portion 4.

At this time, at a first predetermined position 13 below the front opening/closing cover 9 in the closed state in the housing body 2*a*, an adhesive tape cartridge TK (tape cartridge) is detachably attached. The adhesive tape cartridge TK is provided with a first roll R1, a third roll R3, and a connecting arm 16 for connecting the first roll R1 and the third roll R3.

The first roll R1 is supported by the connecting arm 16 on a rear side of the adhesive tape cartridge TK and is rotatable when the adhesive tape cartridge TK is attached to the housing body 2*a*. The first roll R1 has a print-receiving adhesive tape 150 consumed by feeding-out wound around an axis O1 in the left-and-right direction in advance. At this time, the first roll R1 is received in the first accommodating portion 3 from above by attachment of the adhesive tape cartridge TK and accommodated in a state in which the axis O1 of winding of the print-receiving adhesive tape 150 is oriented in the left-and-right direction. The first roll R1 feeds out the print-receiving adhesive tape 150 by rotating in a predetermined rotating direction (an A direction in FIG. 2) in the first accommodating portion 3 in the state accommodated in the first accommodating portion 3 (in the state in which the adhesive tape cartridge TK is attached). The print-receiving adhesive tape 150 has a base layer 153, an adhesive layer 152, and a separation material layer 151 laminated from one side (upper side in a partially enlarged view in FIG. 2) to the other side (lower side in the partially enlarged view in FIG. 2) in a thickness direction in this order. The base layer 153 is a layer on which a desired print is formed by the print head 11 which will be described later. The adhesive layer 152 is a layer for bonding the base layer 153 on an appropriate bonded body (not shown). The separation material layer 151 is a layer covering the adhesive layer 152.

Moreover, the feeding roller 12 is disposed on the upper side between the first accommodating portion 3 and the third accommodating portion 5 in the housing body 2*a*. The feeding roller 12 is driven by a feeding motor M1 disposed on the housing body 2*a* through a gear mechanism (not shown) so as to feed the print-receiving adhesive tape 150 fed out of the first roll R1 accommodated in the first accommodating portion 3 in a tape posture in which a tape width direction is the left-and-right direction.

Moreover, the print head 11 is provided on the head holding body 10 disposed on the first opening/closing cover 8*a*. The print head 11 can relatively get close to/separate from the feeding roller 12 by rotational movement of the first opening/closing cover 8*a* around the rotational movement axis K1 as described above. That is, if the first opening/closing cover 8*a* is in the closed state, the print head 11 gets close to the feeding roller 12, while if the first opening/closing cover 8*a* is in the open state, the print head 11 separates from the feeding roller 12. This print head 11 is arranged at a position faced with the upper part of the feeding roller 12 in the first opening/closing cover 8*a* in the closed state in the head holding body 10 so that the print-receiving adhesive tape 150 being fed by the feeding roller 12 is sandwiched in collaboration with the feeding roller 12. Therefore, if the first opening/closing cover 8*a* is in the closed state, the print head 11 and the feeding roller 12 are arranged by facing each other in the vertical direction. The print head 11 forms the desired print on the base layer 153 of the print-receiving adhesive tape 150 sandwiched by the feeding roller 12 by using an ink ribbon IB of a ribbon cartridge RK which will be described later so as to form an adhesive tape 150' with print.

Moreover, at this time, at a second predetermined position 14 below the first opening/closing cover 8*a* in the closed state in the housing body 2*a* and above the adhesive tape cartridge TK, the ribbon cartridge RK is detachably attached. The ribbon cartridge RK is provided with a ribbon supply roll R4 and a ribbon take-up roll R5.

The ribbon supply roll R4 is rotatably supported on a rear side of the ribbon cartridge RK and feeds out the ink ribbon IB for forming a print by the print head 11 by rotating in a predetermined rotating direction (a D direction in FIG. 2) in a state in which the ribbon cartridge RK is attached.

The ribbon take-up roll R5 is rotatably supported on a front side of the ribbon cartridge RK and takes up the used ink ribbon IB after the print is formed by rotating in a predetermined rotating direction (an E direction in FIG. 2) in the state in which the ribbon cartridge RK is attached.

Moreover, on a downstream side of the print head 11 along a tape feeding direction in the first opening/closing cover 8*a*, a ribbon take-up roller 15 is provided. The ribbon take-up roller 15 guides the used ink ribbon IB to the ribbon take-up roll R5.

That is, the ink ribbon IB fed out of the ribbon supply roll R4 is arranged on the print head 11 side of the print-receiving adhesive tape 150 in the state sandwiched between the print head 11 and the feeding roller 12 and is brought into contact with a lower part of the print head 11. Then, after the ink of the ink ribbon IB is transferred by heating from the print head 11 on the base layer 153 of the print-receiving adhesive tape 150 and the print is formed, the used ink ribbon IB is taken up by the ribbon take-up roll R5 while being guided by the ribbon take-up roller 15.

The connecting arm 16 is provided with a peeling-off portion 17 having a substantially horizontal slit shape, for example, on an upstream side of the third roll R3 along the tape feeding direction. The peeling-off portion 17 is a portion to peel off the separation material layer 151 from the adhesive tape 150' with print fed out of the first roll R1 and fed to the front side. By peeling-off of the separation material layer 151 from the adhesive tape 150' with print by the peeling-off portion 17, the tape is separated into the separation material layer 151 and an adhesive tape 150" with print formed of the base layer 153 and the adhesive layer 152 other than that. Then, the peeled-off separation material layer 151 is taken up and wound, whereby the above described third roll R3 is formed. Moreover, the adhesive tape 150" with print from which the separation material layer 151 has been peeled off is wound on the outer peripheral side of winding core member 40 which will be described later so that a second roll R2 which will be described later is formed.

The third roll R3 is supported by the connecting arm 16 on the front side of the adhesive tape cartridge TK (that is, on the downstream side of the first roll R1 along the tape feeding direction). In the state in which the adhesive tape cartridge TK is attached to the housing body 2*a*, the third roll R3 is rotatable and winds the separation material layer 151 having been peeled off the adhesive tape 150' with print around an axis O3 in the left-and-right direction. At this time, the third roll R3 is received in the third accommodating portion 5 from above by attachment of the adhesive tape cartridge TK and is accommodated in the state in which the winding axis O3 of the separation material layer 151 is oriented in the left-and-right direction. Subsequently, the third roll R3 is driven by a separation sheet take-up motor M3 disposed on the housing body 2*a* through the gear mechanism (not shown) in a state accommodated in the third accommodating portion 5 (state in which the adhesive tape cartridge TK is attached) and takes up the separation material layer 151 by rotating in a predetermined rotating direction (a C direction in FIG. 2) in the third accommodating portion 5. A configuration of the connecting arm 16 other than the above and a support configuration of the first roll R1 and the third roll R3 will be described later in more detail.

Moreover, in the second accommodating portion 4, a winding core member 40 around which the adhesive tape 150" with print obtained by peeling off the separation material layer 151 from the adhesive tape 150' with print is sequentially wound is received from above and accommodated so as to be rotatably supported around an axis O2 in the state in which the winding axis O2 of the adhesive tape 150" with print is oriented in the left-and-right direction. Subsequently, the winding core member 40 is driven by the adhesive take-up motor M2 disposed on the housing body 2*a* through the gear mechanism in the state accommodated in the second accommodating portion 4 and takes up and laminates the adhesive tape 150" with print by rotating in a predetermined rotating direction (a B direction in FIG. 2) in the second accommodating portion 4. As a result, the adhesive tape 150" with print is sequentially wound on the outer peripheral side of the winding core member 40, and the second roll R2 is formed. Moreover, on an inner surface of the front opening/closing cover 9, a pressing roller 37 supported in a direction toward an outer peripheral surface of the second roll R2 through a predetermined urging member is disposed. If an outer diameter of the second roll R2 is sufficiently large, a tip end of the pressing roller 37 is urged to and brought into contact with the outer peripheral surface of the second roll R2. Configurations of the above described winding core member 40 and the periphery of the axis O2 will be described later in more detail.

<Outline of Operation of Adhesive Tape Printer>

Subsequently, an outline of an operation of the adhesive tape printer 1 will be described.

That is, when the adhesive tape cartridge TK is attached at the first predetermined position 13, the first roll R1 is accommodated in the first accommodating portion 3 located on the rear side of the housing body 2*a*, and the third roll R3 is accommodated in the third accommodating portion 5 located on the front side of the housing body 2*a*. Moreover, in the second accommodating portion 4 located on the front side of the housing body 2*a*, the winding core member 40 for forming the second roll R2 is accommodated.

At this time, if the feeding roller 12 is driven, the print-receiving adhesive tape 150 to be fed out by rotation of the first roll R1 accommodated in the first accommodating portion 3 is fed to the front side. Then, a desired print is formed by the print head 11 on the base layer 153 of the print-receiving adhesive tape 150 being fed, and the adhesive tape 150' with print is formed. The adhesive tape 150' with print formed is further fed to the front side, and when it is fed to the peeling-off portion 17, the separation material layer 151 is peeled off in the peeling-off portion 17. The peeled-off separation material layer 151 is fed to a lower side and introduced into the third accommodating portion 5 and wound in the third accommodating portion 5, and the third roll R3 is formed.

On the other hand, the adhesive tape 150" with print from which the separation material layer 151 has been peeled off is further fed to the front side and introduced into the second accommodating portion 4 and wound on the outer peripheral side of the winding core member 40 in the second accommodating portion 4, and the second roll R2 is formed. At that time, a cutter mechanism 30 disposed on the front opening/closing cover 9 on the rear side of the second roll R2, that is, on an upstream side of the second roll R2 along the tape feeding direction cuts the adhesive tape 150" with print on which the print is formed and from which the separation material layer 151 has been peeled off. As a result, the adhesive tape 150" with print being wound around the second roll R2 at timing desired by the user can be cut and the second roll R2 can be taken out of the second accommodating portion 4 after the cutting.

<Detailed Structure of Each Portion>

Subsequently, a detailed structure of each portion of the adhesive tape printer 1 will be described in order.

<Adhesive Tape Cartridge>

In FIGS. 6 and 7, the adhesive tape cartridge TK is provided with, as described above, the first roll R1, the third roll R3, and the connecting arm 16. The connecting arm 16 is provided with a pair of left and right first bracket portions 20 and 20 disposed on the rear side and a pair of left and right second bracket portions 21 and 21 disposed on the front side. In FIG. 7, the print-receiving adhesive tape 150 wound around the axis O1 in the first roll R1 and the separation material layer 151 wound around the axis O3 in the third roll R3 are not shown, and a part of members constituting the first roll R1 and the third roll R3 is not shown.

The first bracket portions 20 and 20 sandwich the first roll R1 from both the left and night sides along the axis O1 and holds the first roll R1 rotatably around the axis O1 in a state in which the adhesive tape cartridge TK is attached to the housing body 2*a*. These first bracket portions 20 and 20 are connected by a first connection portion 22 extended substantially along a left-and-right direction on an upper end portion, avoiding interference with an outer diameter of the first roll R1.

The second bracket portions 21 and 21 sandwich the third roll R3 from both the left and night sides along the axis O3 and holds the third roll R3 rotatably around the axis O3 in a state in which the adhesive tape cartridge TK is attached to the housing body 2*a*. These second bracket portions 21 and 21 are connected by a second connection portion 23 extended substantially along the left-and-right direction on the upper end portion.

The first bracket portions 20 and 20 and the first connection portion 22 on the rear side and the second bracket portions 21 and 21 and the second connection portion 23 on the front side are connected by a pair of left and right roll connecting beam portions 24 and 24.

Here, as described above, when the adhesive tape cartridge TK is in use, by feeding the print-receiving adhesive tape 150 out of the first roll R1 and feeding the same, the print-receiving adhesive tape 150 is consumed. On the other hand, the print receiving-adhesive tape 150 is fed to the third roll R3, and the separation material layer 151 peeled off by the above described peeling-off portion 17 from the adhesive tape 150' with print on which the print is formed is wound around the axis O3.

As the result of the use form as above, if the tape roll freely rotates in the state of a single body of the adhesive tape cartridge TK before attachment to the housing, the tape might become disarrayed or loose. In this case, the disarray or loosening of the tape needs to be solved at attachment of the adhesive tape cartridge TK to the housing, and handling performance by the user deteriorates.

Thus, in the present embodiment, as illustrated in FIGS. 8A to 10B, an outer diameter D1 of a first shaft end portion R1*a* disposed on both sides in an axial direction of the first roll R1 is set to a dimension sufficiently smaller than an inner diameter D2 of a first shaft hole portion R1*b* for insertion at each of the first bracket portions 20 and 20. That is, each of the first shaft end portions R1*a* is loosely fitted in each of the first shaft hole portions R1*b* with a sufficient gap. A plurality of outer peripheral projecting portions 61 are disposed at equal intervals on an outer peripheral surface of each of the first shaft end portions R1*a* on the entire circumferential direction, and a plurality of inner peripheral projecting portions 62 are disposed at equal intervals on an inner peripheral surface of each of the first shaft hole portions R1*b* on the entire circumferential direction. In this example, the outer peripheral projecting portions 61 and the inner peripheral projecting portions 62 are disposed in the same number and having the same projecting height and shape.

For example, if the adhesive tape cartridge TK is attached to the housing body 2*a*, as illustrated in FIGS. 8A and 8B, the first shaft end portions R1*a* and the first shaft hole portions R1*b* are coaxially arranged. In this state, the outer peripheral surfaces of the first shaft end portions R1*a* and the inner peripheral surfaces of the first shaft hole portions R1*b* are separated with the same gap between them over the entire circumferential direction, and the above described inner peripheral projecting portion 62 and the outer peripheral projecting portion 61 are set to have the respective projecting height dimensions so that they do not engage (interfere) with each other in this gap. That is, the inner peripheral surface of the first shaft hole portion R1*b* and the outer peripheral surface of the first shaft end portion R1*a* are configured so as to be faced with each other in the radial direction through a predetermined interval so that the inner peripheral projecting portion 62 and the outer peripheral projecting portion 61 do not engage with each other. Thus, if the adhesive tape cartridge TK is attached to the housing body 2*a*, the first end portion R1*a* is rotatable in the first shaft hole portion R1*b*.

Moreover, since the connecting arm 16 has the structure for holding the first roll R1 in a suspended state, in the state in which the adhesive tape cartridge TK is removed from the housing body 2*a* and lifted up as illustrated in FIGS. 9A and 9B, the first roll R1 relatively moves downward by gravity, and the first shaft end portion R1*a* is brought into contact with the lower side of the first shaft hole portion R1*b*. As a result, the inner peripheral projecting portion 62 is engaged with the outer peripheral projecting portion 61, and the first roll R1 is made unrotatable.

Moreover, in a state in which the adhesive tape cartridge TK is placed on a table or the like as illustrated in FIGS. 10A and 10B, the first roll R1 relatively moves upward and the first shaft end portion R1*a* is brought into contact with the upper side of the first shaft hole portion R1*b*. As a result, in this case, too, the inner peripheral projecting portion 62 is engaged with the outer peripheral projecting portion 61, and the first roll R1 is made unrotatable.

As described above, in the state of the adhesive tape cartridge TK alone before being attached to the housing body 2*a*, the inner peripheral projecting portion 62 is engaged with the outer peripheral projecting portion 61 so as to bring the first roll R1 into an unrotatable state, while in the state in which the adhesive tape cartridge TK is attached to the housing body 2*a*, the inner peripheral projecting portion 62 is not engaged with the outer peripheral projecting portion 61, and the first roll R1 can be brought into a rotatable state. As a result, disarray or loosening of the tape in the state of the adhesive tape cartridge TK alone can be suppressed.

Moreover, in the present embodiment, a second shaft end portion R3*a* disposed on both sides in the axial direction of the third roll R3 and a second shaft hole portion R3*b* for insertion in each of the second bracket portions 21 and 21 also have the similar supporting configuration (the outer peripheral projecting portion 61 and the inner peripheral projecting portion 62). Enlarged views in FIGS. 8B, 9B, and 10B illustrate a support state of the first shaft hole portion R1*b* and the first shaft end portion R1*a* and the support state of the second shaft hole portion R1*b* and the second shaft end portion R1*a* in corresponding FIGS. 8A, 9A, and 10A, respectively.

<Detailed Structure of Cutter Mechanism>

As illustrated in FIGS. 11, 12, and 13, the cutter mechanism 30 has a guide plate 31, a movable blade 32, a running body 33 provided with a movable blade support portion 33*a* supporting the movable blade 32, and a guide rail 34.

The guide plate 31 is extended in the tape width direction on the downstream side in the tape feeding direction from the feeding roller 12 inside an open edge side of the second opening/closing cover 4. This guide plate 31 is supported by a pair of left and right support plates 35*a* and 35*b* with respect to the second opening/closing cover 4. The guide plate 31 is brought into contact with and guides upper surfaces of the adhesive tapes 152 and 153 (in other words, the upper surface of the base layer 153) with print fed by the feeding roller 12 in the above described housing 2 in a posture in which the tape width direction is the left-and-right direction (see virtual lines in FIGS. 12 and 13).

Below the guide plate 31, the above described movable blade 32 is arranged so as to have an edge 32*a* faced with the guide plate 31 in the vertical direction (so that the edge 32*a* is oriented upward in this example). The movable blade 32 runs in the tape width direction along the guide plate 31 by the above described running body 33 guided by the guide rail 34 and made to run by driving of a cutter motor M4 and performs cutting (see an arrow C in FIG. 12). The above described guide rail 34 is supported by the above described pair of left and right support plates 35*a* and 35*b* with respect to the second opening/closing cover 4.

The movable blade 32 advances from the adhesive layer 152 on the lowest layer to the adhesive tapes 152 and 153 with print and performs the cutting while sandwiching the adhesive tapes 152 and 153 with print between the guide plate 31 and itself by the running of the running body 33 along the guide rail 34. At that time, the above described movable blade support portion 33*a* supports the movable blade 32 with respect to the running body 33 so that the edge 32*a* of the movable blade 32 (see FIG. 12) is inclined in a form pressing the adhesive tapes 152 and 153 with print to a direction of the guide plate 31 to the running direction along the tape width (in descending inclination in this example). As a result, the adhesive tapes 152 and 153 with print are cut by the edge 32*a* of the movable blade 32 arranged below and oriented diagonally upward in the width direction and advancing from the adhesive layer 152 on the lowest layer and cutting into while the upper surface (in more detail, the upper surface of the base layer 153 after the print is formed by the print head 11) is brought into contact with and guided by the guide plate 31. At this time, a slit 31*a* is drilled in the tape width direction in the guide plate 31 in order to guide running of the movable blade 32 by the running body 33.

On the downstream side of the guide plate 31 along the tape feeding direction, a chute 15 for switching feeding paths of the adhesive tapes 152 and 153 with print between a side toward the second roll R2 and a side toward a discharging exit 12.

<Detailed Configuration Around Winding Core Member and Axis O2>

Moreover, in the present embodiment, a single body of the winding core member 40 is attached to the second accommodating portion 4 as described above, and the adhesive tape 150" with print is taken up on the outer peripheral side of this winding core member 40 and laminated so that the second roll R2 is formed. In FIGS. 14 to 16, two bearing portions 39 which are projections each having a substantially columnar shape are fixedly disposed on the both left and right sides along the axis O2 direction by facing each other when the second roll R2 is attached so as to respectively sandwich the second roll R2 in the second accommodating portion 4 of the housing body 2*a*. The winding core member 40 is supported so that a center part of the winding core member 40 is rotatable by attaching each of the shaft end portions on the both sides in the axial direction thereof to the bearing portions 39, respectively. Moreover, below on the rear side of the left bearing portion 39 in the second accommodating portion 4 of the housing body 2*a*, a part of a tooth surface of a driving gear 38 interlocking with the above described adhesive take-up motor M2 is exposed toward the bearing portion 39. In FIGS. 14 and 15, the second roll R2 is not shown, and in FIGS. 18A and 18B, the adhesive tape 150" with print and the front opening/closing cover 9 are not shown.

In FIG. 16, the winding core member 40 is configured such that the shaft end portions on the both sides in the axial direction are connected and become a support shaft with a small diameter as will be described later in detail, and this penetrates a shaft center of a drum portion 50 at the center around which the adhesive tape 150" with print is wound and supports it rotatably (see FIG. 17 which will be described later). On an outer periphery on the right side of the drum portion 50, a first outer tube 42 provided with a flange having a substantially annular shape is attached, while on the outer periphery on the left side of the drum portion 50, a second outer tube 43 provided with a flange having the substantially annular shape is attached. This second outer tube 43 is attached movably in the axial direction (left-and-right direction) within a predetermined range on a left end side of the winding core member 40. As a result, the adhesive tape 150" with print wound around the winding core member 40 can be sandwiched by the first outer tube 42 and the second outer tube 43 in accordance with the tape width in the width direction appropriately.

At a predetermined circumferential position on the left end side of the winding core member 40, a portion-to-be-detected 81 whose exposed width changes in accordance with a moved position of the above described second outer tube 43 is disposed. This portion-to-be-detected 81 is formed having a shape so that an exposed amount of an irregular wave changes in accordance with the exposed width (see a broken line portion in the figure). When the winding core member 40 is to be attached to the second accommodating portion 4 of the housing body 2*a*, it is attached so that this portion-to-be-detected 81 is located below. On the second accommodating portion 4 of the housing body 2*a*, a detection portion 82 is disposed at a position faced with the portion-to-be-detected 81 when the winding core member 40 is attached. Though not shown in detail, this detection portion 82 detects the exposed amount of the irregular wave of the portion-to-be-detected 81 faced with itself mechanically or optically and discriminates a position of the above described second outer tube 43 in the axial direction. As a result, the tape width of the adhesive tape 150" with print sandwiched by the first outer tube 42 and the second outer tube 43 can be automatically detected on the adhesive tape printer 1 side, and moreover, a type and a base diameter of the second roll R2 can be also discriminated on the basis of this tape width.

Moreover, on a position in the vicinity of a lower part of the left bearing portion 39 (a rear surface position of the bearing portion 39 when seen in FIG. 16), a projecting portion 36 having a substantially square cylinder shape is disposed (which will be described later in detail).

In FIGS. 17 and 18, the winding core member 40 is provided with a substantially cylindrical inner tube 41

(winding tube), the first outer tube 42, the second outer tube 43, a shaft member 51, a driven gear 52, and a lock member 53 sharing the above described axis O2 as their axes.

The first outer tube 42 is detachably attached to the outer peripheral side of one side end portion (a right end portion in detail) along the axial direction of the inner tube 41 (that is, left-and-right direction which is the axis O2 direction). This first outer tube 42 is provided with a substantially cylindrical first cylinder portion 45 and a substantially annular-shaped first flange portion 46 formed integrally on a right end portion of the first cylinder portion 45.

The second outer tube 43 is attached to the outer peripheral side of the other side end portion (a left end portion in detail) along the axial direction of the inner tube 41 (that is, left-and-right direction which is the axis O3 direction). This second outer tube 43 is provided with a substantially cylindrical second cylinder portion 47 and a substantially annular-shaped first flange portion 48 formed integrally on a left end portion of the second cylinder portion 47. This second outer tube 43 is, as described above, attached movably in the axial direction (left-and-right direction) within a predetermined range on the left end side of the winding core member 40. The inner tube 41, the first outer tube 42, and the second outer tube 43 constitute the above described drum portion 50.

In a state in which the first outer tube 42 and the second outer tube 43 are attached to the inner tube 41, the first flange portion 46 and the second flange portion 48 are arranged by facing each other in the axial direction, and a space that can receive the above described adhesive tape 150" with print is formed between the first flange portion 46 and the second flange portion 48.

Moreover, in a state in which the first outer tube 42 and the second outer tube 43 are attached to the inner tube 41, the first cylinder portion 45 and the second cylinder portion 47 are extended substantially along the axis O2 so as to connect the first flange portion 46 and the second flange portion 48, and to the outer peripheral sides of the first cylinder portion 45 and the second cylinder portion 47 (in other words, the space between the first flange portion 46 and the second flange portion 48), a substantially cylindrical paper core 44 can be attached. The paper core 44 is a supply member for being wound with the adhesive tape 150" with print obtained by peeling off the separation material layer 151 from the adhesive tape 150' with print in the aforementioned peeling-off portion 17 on an outer peripheral side so that the tape width direction is the left-and-right direction. FIG. 18 illustrates a state in which the paper core 44 is not attached to the outer peripheral sides of the first cylinder portion 45 and the second cylinder portion 47 (the same applies to FIG. 16).

The shaft member 51 is a member having substantially columnar shape in general and is provided with a first engagement portion 51*a* capable of being attached to the above described bearing portion 39 installed on the housing body 2*a* on an end portion on the right side, a shank portion 51*b* having a diameter smaller than that of the first engagement portion 51*a* at a center part in the axial direction, and a shaft connection portion 51*c* on an end portion on the left side. A through hole 41*a* is disposed at a shaft center of the inner tube 41, and by penetration of the shank portion 51*b* of the shaft member 51 through this through hole 41*a*, the inner tube 41 is rotatably supported by the shaft member 51.

The driven gear 52 is a gear capable of being meshed with the driving gear 38 disposed on the second accommodating portion 4 of the housing body 2*a*, and an insertion tube 52*a* provided with a key on an outer peripheral surface is disposed at a center on an end face on the right side. By inserting this insertion tube 52*a* through a left end opening portion of the through hole 41*a* of the inner tube 41, the driven gear 52 and the inner tube 41 (and the first outer tube 42 and the second outer tube 43) can integrally rotate. A through hole 52*b* is formed also at an shaft center of the entire driven gear 52 including the insertion tube 52*a*, and a left end portion of the above described shaft member 51 can penetrate the inner tube 41 and the driven gear 52 which are connected.

The lock member 53 is provided with a substantially cup-shaped cover portion 53*a* capable of accommodating the above described entire driven gear 52 therein, an operation portion 53*b* disposed at a predetermined position in a circumferential direction on an outer periphery of this cover portion 53*a*, a second engagement portion 53*c* disposed at a shaft center position on a left end face of the cover portion 53*a*, and a hook portion 53*d* disposed in the vicinity of this second engagement portion 53*c*. A shaft center position on an inner surface of this lock member 53 (right end face of the cover portion 53*a*) can be detachably connected to the shaft connection portion 51*c* on the left end portion of the above described shaft member 51. Moreover, the second engagement portion 53*c* of the look member 53 can be attached to the above described bearing portion 39 installed on the housing body 2*a* similarly to the above described first engagement portion 51*a* of the shaft member 51. Moreover, at a predetermined position in the circumferential direction of the cover portion 53*a*, an exposing hole 53*e* for exposing a part of a tooth surface of the above described driven gear 52 is disposed. Moreover, in the vicinity of the hook portion 53*d*, an exposure hole 53*f* which will be described later in detail is disposed. The second engagement portion 53*c* and the exposure hole 53*f* will be described later in detail (see FIGS. 19A to 19C which will be described later).

Here, an example of an assembling procedure of the winding core member 40 will be described. That is, when the winding core member 40 is to be assembled, first, the second cylinder portion 47 of the second outer tube 43 is externally inserted through the outer peripheral side of the left end portion of the inner tube 41. At this time, the paper core 44 is not attached to the outer peripheral side of the second cylinder portion 47 yet, the second outer tube 43 including the second flange portion 48 is movable in the left-and-right direction as described above. While the left end portion of the paper core 44 is brought into contact with a right end face 48*a* of the second flange portion 48 in the second outer tube 43, the left end portion of the paper core 44 is slightly fitted on the outer peripheral side of the second cylinder portion 47. At this time, by moving the second outer tube 43 in the left-and-right direction in accordance with a width direction dimension of the paper core 44, an axial position of the paper core 44 can be determined. When the paper core 44 is completely attached to the outer peripheral side of the second cylinder portion 47, the second outer tube 43 including the second flange portion 48 is fixed to the outer peripheral side of the inner tube 41 and cannot move in the left-and-right direction. Then, the first outer tube 42 including the first flange portion 46 is detachably attached to the outer peripheral portion on the right end portion of the inner tube 41 where the paper core 44 is present on the outer peripheral side. At this time, the paper core 44 has its right end portion positioned by the first flange portion 46 so that the right end portion is in contact with a left end face 46*a* of the first flange portion 46 in the first outer tube 42.

Moreover, the driven gear 52 is attached to the left end portion of the inner tube 41, and the driven gear 52 is covered by the lock member 53. Then, the shaft connection portion 51*c* and the shank portion 51*b* of the shaft member 51 are made to penetrate through the through hole at the shaft center of the inner tube 41 and the driven gear 52 integrally connected, and a tip end of the shaft connection portion 51*c* is detachably connected to an inner surface of the lock member 53. As a result, the winding core member 40 is assembled (see FIGS. 18A and 18B). In this assembled state, the inner tube 41, the first outer tube 42, the second outer tube 43, the paper core 44, and the driven gear 52 are integrally connected, while the shaft member 51 and the lock member 53 are integrally connected. A torque transmitted to the driven gear 52 is transmitted to the inner tube 41, the first outer tube 42, the second outer tube 43, and the paper core 44 and rotates with respect to the shaft member 51 and the lock member 53.

Subsequently, if the entire winding core member 40 is accommodated in the aforementioned second accommodating portion 4 in a state in which the first engagement portion 51*a* of the shaft member 51 and the second engagement portion 53*c* of the lock member 53 are attached so as to be supported by the above described two bearing portions 39, respectively, the driven gear 52 is meshed with the driving gear 38, and the above described adhesive tape 150" with print is taken up. That is, while the adhesive tape 150" with print is sequentially wound on the outer peripheral side of the paper core 44, the entire winding core member 40 rotates around the axis O2. As a result, the adhesive tape 150" with print is sequentially wound and laminated on the outer peripheral side of the paper core 44, and the second roll R2 is formed. At this time, in order to smoothen start of a winding operation as above, a leader tape 80 is disposed on the paper core 44 (see FIG. 17). A tip end portion 80*a* having a substantially snakehead shape of the leader tape 80 is extended toward the outside of the paper core 44. To this tip end portion 80*a*, the adhesive layer 152 provided in the adhesive tape 150" with print is bonded and connected. As a result, by rotation of the entire winding core member 40 including the paper core 44 around the axis O2, the adhesive tape 150" with print connected to the tip end portion 80*a* of the leader tape 80 is pulled into the paper core 44 side and sequentially wound and laminated on the outer peripheral portion of the paper core 44, and the second roll R2 is formed.

The winding core member 40 is capable of repeating disassembling and assembling by the unit of all the members including the paper core 44. As a result, with the rotation of the winding core member 40, the adhesive tape 150" with print is sequentially introduced into the space between the above described first flange portion 46 and the second flange portion 48, the adhesive tape 150" with print is laminated on the paper core 44 mounted on the first cylinder portion 45 and the second cylinder portion 47, and the second roll R2 is formed and then, the entire winding core member 40 can be disassembled, and only the second roll R2 can be removed.

When the above described winding core member 40 is to be attached to the second accommodating portion 4 of the housing body 2*a*, it is desirable that power is reliably transmitted to the drum portion 50 (the inner tube 41, the first outer tube 42, and the second outer tube 43), operability is high and their structures are simple. Thus, in the present embodiment, the following attachment configuration is provided.

FIGS. 19A to 19C schematically illustrate a process in which the winding core member 40 of the present embodiment is attached to the second accommodating portion 4 of the housing body 2*a*. FIG. 19A illustrates a state before the winding core member 40 is accommodated, FIG. 19B for a state immediately after the winding core member 40 is accommodated, and FIG. 19C for a state in which accommodating of the winding core member 40 is locked, respectively, and each figure illustrates only the bearing portion 39 on the housing body 2*a* side, the driving gear 38, and the winding core member 40.

First, in FIG. 19A, the bearing portion 39 disposed on the housing body 2*a* (not shown in the figure) has so-called D-cut portions 39*a* at two spots. The D-cut portion 39*a* is a portion in which a part (an arc portion) on an outer peripheral portion is cut so as to form a chord in an axial section of the substantially columnar bearing portion 39. Though not particularly shown, this D-cut portion 39*a* has a plane formed at a position corresponding to the chord when the shaft member 51 is seen from the side surface. In the present embodiment, in the one bearing portion 39, the D-cut portions 39*a* are arranged at two spots so as to face each other in point symmetry with respect to its center line. As a result, in the bearing portion 39, a separation distance between the two D-cut portions 39*a* becomes a minimum diameter Ds, and a diameter between the remaining two arc portions becomes a maximum diameter Db.

Moreover, in the second engagement portion 53*c* disposed at the axis position of the lock member 53, a round hole portion 71 having a diameter substantially equal to the above described maximum diameter Db of the bearing portion 39 and a slot portion 72 communicating with this round hole portion 71 and having a width substantially equal to the above described minimum diameter Ds of the bearing portion 39 are disposed. With such configuration, when the winding core member 40 is to be attached to the housing body 2*a*, the bearing portion 39 is fitted in the slot portion 72 of the second engagement portion 53*c* and advances into the round hole portion 71 (see FIG. 19B). Subsequently, by the operation of the lock member 53 through the operation portion 53*b*, the lock member 53 rotates (swings) around the axis (which is the same as the above described axis O2 in this example) and then, the bearing portion 39 is fitted in the round hole portion 71 of the second engagement portion 53*c* while relatively rotates in the round hole portion 71 (see FIG. 19C). As a result, the bearing portion 39 can no longer be fitted in the slot portion 72 again nor move to the outside of the round hole portion 71. As described above, the second engagement portion 53*c* of the lock member 53 and the bearing portion 39 are fixed by engagement. A swing direction of the lock member 53 at this time is the same as the rotating direction of the above described driven gear 52.

Though not particularly shown, in the first engagement portion 51*a* provided on the right end portion of the shaft member 51 and the bearing portion 39 corresponding to that, too, the attachment configuration similar to the above is disposed. As described above, since the bearing portion 39 and the lock member 53 are integrally connected through the shaft connection portion 51*c*, the swing operation in the lock member 53 interlocks with the first engagement portion 51*a* of the shaft member 51 as it is. In order to attach the first engagement portion 51*a* and the second engagement portion 53*c* to the corresponding bearing portions 39 at the same time, respectively, the circumferential positions of the respective slot portions 72 need to match. The exposed hole 53*e* of the lock member 53 is formed so as to expose the tooth surface of the driven gear 52 with an arc length corresponding to the swing width of the operation portion 53*b* in order to avoid interference of the cover portion 53*a* with a meshed point between the driving gear 38 and the driven gear 52.

Subsequently, as illustrated in FIG. 19C, by fixing the shaft member 51 to the bearing portion 39 by the lock member 53, the driven gear 52 is positioned, and thus, the tooth skip at the meshed point (connection portion) between the driving gear 38 and the driven gear 52 can be suppressed. As a result, the power of the driving gear 38 can be reliably transmitted to the drum portion 50.

Moreover, in the present embodiment, in order to fix the winding core member 40 to the second accommodating portion 4 of the housing body 2*a* more reliably, the projecting portion 36 is disposed on the housing body 2*a* and the hook portion 53*d* on the lock member 53, respectively.

FIGS. 20A and 20B specifically illustrate appearances of a process of locking the projecting portion 36 of the housing body by the hook portion 53*d* of the lock member 53, in which FIG. 20A corresponds to FIG. 19B and FIG. 20B to FIG. 19C, respectively. In each figure, the projecting portion 36 fixedly disposed on the housing body 2*a* side is indicated by a broken line.

As described above, the projecting portion 36 is disposed in the vicinity of the lower part of the bearing portion 39. The hook portion 53*d* is formed integrally on the lock member 53 and disposed at a position not interfering with the projecting portion 36 at attachment of the winding core member 40 to the housing body 2*a* (see FIG. 20A). When the lock member 53 rotates (swings) around the axis by the operation of the lock member 53 through the operation portion 53*b*, the hook portion 53*d* is locked on the lower surface of the projecting portion 36 (see FIG. 20B). By this locking of the hook portion 53*d*, the shaft member 51 can be fixed to the bearing portion 39 further firmly.

Moreover, the projecting portion 36 is formed having a hollow shape as described above, and its opening portion 36*a* is directed toward the winding core member 40 side. Though not particularly shown, an optical sensor combining a light emitting portion and a light receiving portion adjacently is disposed inside the housing body 2*a* (see FIG. 21 which will be described later), and projection light from the light emitting portion is projected to the winding core member 40, and its reflection light is received by the light receiving portion. A hollow hole inside the projecting portion 36 becomes a passage hole for the projection light and the reflection light. In accordance with that, the exposure hole 53*f* of the lock member 53 does not overlap with the opening portion 36*a* of the projecting portion 36 at a position before lock of the lock member 53 and shields the projection light (see FIG. 20A) and overlaps with the opening portion 36*a* of the projecting portion 36 at a position after lock of the lock member 53 and allows the projection light to pass. As a result, presence of the lock state of the winding core member 40 can be detected by the optical sensor. Moreover, the projection light having passed through the exposure hole 53*f* of the lock member 53 is projected to the driven gear 52, but since the slit holes 52*c* are disposed at equal intervals in the circumferential direction in the driven gear 52 as illustrated in FIG. 17, a so-called rotary encoder is constituted, and the rotation state of the second roll R2 can be detected. Though not particularly shown, the configuration of this rotary encoder is also disposed on the third roll R3.

<Control System>

Subsequently, a control system of the adhesive tape printer 1 will be described using FIG. 21. In FIG. 21, a CPU 212 constituting a computing unit executing predetermined calculation is provided in the adhesive tape printer 1. The CPU 212 is connected to a RAM 213 and a ROM 214. The CPU 212 executes signal processing in accordance with a program stored in the ROM 214 in advance by using a temporary storage function of the RAM 213 and thereby controls the entire adhesive tape printer 1. At this time, a control program for executing control processing which will be described later is stored in the ROM 214. This CPU 212 is connected to a motor drive circuit 218 for executing driving control of the above described feeding motor M1 driving the above described feeding roller 12, a motor drive circuit 219 for executing driving control of the above described adhesive take-up motor M2 driving the above described second roll R2, a motor drive circuit 220 for executing driving control of the above described separation sheet take-up motor M3 driving the above described third roll R3, a print-head control circuit 221 for executing charging control of a heating element of the above described print head 11, and a motor drive circuit 222 for executing driving control of the above described cutter motor M4 for running the movable blade 32 of the above described cutter mechanism 30.

Moreover, to the CPU 212, a display portion 215, an operation portion 216, two optical sensors 223 and 224 corresponding to the second roll R2 and the third roll R3, respectively, and a PC 217 are connected.

The ROM 214 stores print data (dot pattern) such as characters, symbols and the like to be received from the PC 217 and printed, associated with code data, and the CPU 212 creates print data to be printed on a print area of the above described print label L by using this stored print data. The CPU 212 feeds out the print-receiving tape 150 by the feeding roller 12 and produces the adhesive tape by having the print head 11 apply print through the print-head control circuit 217 in accordance with the created print data.

<Print Processing Control Contents>

Subsequently, by using FIGS. 22 to 28, control contents of print processing executed by the CPU 212 of the adhesive tape printer 1 will be described. First, in FIG. 22, when power of the adhesive tape printer 1 is turned on by an operator, for example, this flow is started ("START" position).

First, at Step S5, the CPU 212 makes a selection input of a processing mode by a mode selection operation by a user through the operation portion 216.

Subsequently, at Step S10, the CPU 212 determines whether or not the processing mode selected and input at Step S5 is a preparation mode. If the preparation mode has been selected, the determination is satisfied (S10: YES), and the routine proceeds to Step S100.

At Step S100, preparation mode processing for preparing before normal print processing is executed. Then, this flow is finished.

On the other hand, in the determination at Step S10, if the preparation mode has not been selected, the determination is not satisfied (S10: NO), and the routine proceeds to Step S15.

At Step S15, the CPU 212 determines whether or not the processing mode selected and input at Step S5 is a normal mode. If the normal mode has been selected, the determination is satisfied (S15: YES), and the routine proceeds to Step S200.

At Step S200, normal mode processing for executing the normal print processing is executed. Then, this flow is finished.

On the other hand, in the determination at Step S15, if the normal mode has not been selected, the determination is not satisfied (S15: NO), and the routine proceeds to Step S300.

At Step S300, cutting mode processing for cutting the adhesive tape 150" with print after the normal print processing has been executed is executed. Then, this flow is finished.

The preparation mode, the normal mode, and the cutting mode will be described below, respectively.

<1: Preparation Mode>

FIGS. 23A to 23C schematically illustrate a process of print preparation in the preparation mode. First, the user feeds out the print-receiving adhesive tape 150 from the first roll R1 and passes the fed-out print-receiving adhesive tape 150 between the feeding roller and the print head 11 (See FIG. 23A). During this period, the CPU 212 controls the feeding motor M1 so that the feeding roller is rotated in the feeding direction only for a predetermined time.

Subsequently, the separation material layer is peeled off the print-receiving adhesive tape 150, and the tip end of the adhesive tape 150' with print formed of the base layer and the adhesive layer is fixed to the winding core of the second roll R2. On the other hand, the tip end of the separation material layer peeled off the print-receiving adhesive tape 150 is fixed to the third roll R3 (See FIG. 23B).

In this state, the CPU 212 stops the feeding roller only for a predetermined time and controls the feeding motor M1 and the adhesive take-up motor M2 so that only the second roll R2 is rotated in a take-up direction (see FIG. 23B). As a result, the adhesive tape 150' with print from which the separation material layer has been peeled off is pulled by the stopped feeding roller and the second roll R2 rotating in the take-up direction, and at the time when loosening is removed, the rotation of the second roll R2 is stopped, and a tension works. If the rotation of the second roll R2 is detected at the time when the tension should be acting on the adhesive tape 150' with print as above, it is considered that the second roll R2 idles since fixing of the tip end of the adhesive tape 150' with print to the paper core 44 is defective, and nonconformity is reported.

Subsequently, the CPU 212 stops the feeding roller only for a predetermined time and controls the feeding motor M1 and the separation sheet take-up motor M3 so that only the third roll R3 is rotated in the take-up direction (see FIG. 23C). As a result, the separation material layer peeled off the adhesive tape 150' with print is pulled by the stopped feeding roller and the third roll R3 rotating in the take-up direction, and at the time when loosening is removed, the rotation of the third roll R3 is stopped, and a tension works. Moreover, at this time, even if a separation point between the adhesive tape 150' with print and the separation material layer moves by pulling of the adhesive tape 150' with print by the above described rotation only of the second roll R2, an original position (a tip end position of the peeling-off portion 17) can be restored (see broken line portions in FIGS. 23B and 23C). If rotation of the second roll R2 is detected at the point of time when a tension should be working on the separation material layer as above, it is considered that the third roll R3 idles since fixing of the tip end of the separation material layer to the third roll R3 is defective, and nonconformity is reported.

Subsequently, the CPU 212 controls the feeding motor M1, the adhesive take-up motor M2, and the separation sheet take-up motor M3 so that the feeding roller, the second roll R2, and the third roll R3 are all rotated only for a predetermined time without performing a print operation (though not particularly shown). By performing this preliminary operation, whether a series of operations including feeding-out, feeding, taking up of the print-receiving adhesive tape 150 and taking up of the separation material layer can be performed normally or not can be confirmed in advance.

Control contents of the preparation mode processing S100 executed by the CPU 212 of the adhesive tape printer 1 in order to realize the control contents above will be described by using FIG. 24. In the figure, names of the portions are abbreviated as appropriate for convenience of a limited space (the same applies to the following).

First, at Step S105, the CPU 212 starts driving of the feeding motor M1.

Subsequently, at Step S110, the CPU 212 stands by in a loop until a predetermined time has elapsed since start of driving of the feeding motor M1 at Step S105. The predetermined time for standby in this case may be such that the tip end of the print-receiving adhesive tape 150 fed out of the first roll R1 is fed from the feeding roller 12 and arrives at the second roll R2 or the third roll R3. When the predetermined time has elapsed, the routine proceeds to Step S115.

At Step S115, the CPU 212 stops driving of the feeding motor M1.

Subsequently, at Step S120, the CPU 212 stands by in a loop until an operation of instructing to resume a work by the user through the operation portion 53*b* is input. If the operation of instructing to resume the work is input, the routine proceeds to Step S125.

At Step S125, the CPU 212 starts driving of the adhesive take-up motor M2 (abbreviated as AD motor in the figure).

Subsequently, at Step S130, the CPU 212 stands by in a loop until a predetermined time has elapsed since start of the driving of the adhesive take-up motor M2 at Step S125. The predetermined time for standby in this case may be such that (1 second at the maximum) loosening of the adhesive tape 150' with print from the feeding roller 12 to the second roll R2 is removed, and an appropriate tension can be made to work. When the predetermined time has elapsed, the routine proceeds to Step S135.

At Step S135, the CPU 212 determines whether or not the second roll R2 is rotating at this point of time on the basis of detection contents of the optical sensor 223 corresponding to the second roll R2. If the second roll R2 is not rotating, the determination is not satisfied (S135: NO), and the routine proceeds to Step S140.

At Step S140, the CPU 212 stops the driving of the adhesive take-up motor M2.

Subsequently, at Step S145, the CPU 212 starts driving of the separation sheet take-up motor M3 (abbreviated as a separation sheet motor in the figure).

Subsequently, at Step S150, the CPU 212 stands by in a loop until a predetermined time has elapsed since start of the driving of the separation sheet take-up motor M3 at Step S145. The predetermined time for standby in this case may be such that loosening of the separation material layer from the feeding roller 12 to the third roll R3 also including the aforementioned pulling back at the separation point is removed, and an appropriate tension can be made to work. When the predetermined time has elapsed, the routine proceeds to Step S155.

At Step S155, the CPU 212 determines whether or not the third roll R3 is rotating at this point of time on the basis of detection contents of the optical sensor 224 corresponding to the third roll R3. If the third roll R3 is not rotating, the determination is not satisfied (S155: NO), and the routine proceeds to Step S160.

At Step S160, the CPU 212 stops the driving of the separation sheet take-up motor M3.

Subsequently, at Step S165, the CPU 212 starts the driving of the feeding motor M1, the adhesive take-up motor M2, and the separation sheet take-up motor M3.

Subsequently, at Step S170, the CPU 212 stands by in a loop until a predetermined time has elapsed since start of the driving of each of the motors at Step S165. The predetermined time for standby in this case may be such that whether the series of operations including feeding-out, feeding, taking up of the print-receiving adhesive tape 150 and taking up of the separation material layer can be performed normally or not can be sufficiently confirmed visually. When the predetermined time has elapsed, the routine proceeds to Step S175.

At Step S175, the CPU 212 stops the driving of the feeding motor M1, the adhesive take-up motor M2, and the separation sheet take-up motor M3.

Subsequently, at Step S180, the CPU 212 notifies that all the preparation operations have been normally performed, and the preparation mode processing has been finished by displaying the fact on the display portion or the like. Then, this flow is finished.

On the other hand, in the determination at Step S135, if the second roll R2 is rotating, the determination is satisfied (S135: YES), and the routine proceeds to Step S185.

At Step S185, the CPU 212 stops the driving of the adhesive take-up motor M2.

Subsequently, at Step S190, the CPU 212 considers that the second roll R2 is idling since fixing of the tip end of the adhesive tape 150' with print to the second roll R2 is defective and notifies the fact by displaying it on the display portion or the like. Then, this flow is finished.

On the other hand, in the determination at Step S155, if the third roll R3 is rotating, the determination is satisfied (S155: YES), and the routine proceeds to Step S195.

At Step S195, the CPU 212 stops the driving of the separation sheet take-up motor M3.

Subsequently, at Step S198, the CPU 212 considers that the third roll R3 is idling since fixing of the tip end of the separation material layer in the third roll R3 is defective and notifies the fact by displaying it on the display portion or the like. Then, this flow is finished.

<2. Normal Mode>

FIG. 25 schematically illustrates a process of the normal mode. First, the CPU 212 starts the driving of the feeding motor M1, the adhesive take-up motor M2, and the separation sheet take-up motor M3 with the print operation by the print head 11. If, during the subsequent normal print operation, no rotation is detected by at least either one of the two optical sensors 223 and 224 corresponding to the second roll R2 and the third roll R3, respectively, the CPU 212 determines it to be abnormal. In the normal mode, if rotation of the both second roll R2 and third roll R3 is detected by the two optical sensors 223 and 224, it is normal, and if no rotation is detected by at least either one of the optical sensors 223 and 224, it is considered to be occurrence of malfunction caused by jamming of the tape or the like, and nonconformity is notified.

Control contents of the normal mode processing S200 executed by the CPU 212 of the adhesive tape printer 1 in order to realize the control contents above will be described by using FIG. 26.

First, at Step S205, the CPU 212 starts the driving of the feeding motor M1, the adhesive take-up motor M2, and the separation sheet take-up motor M3.

Subsequently, at Step S210, the CPU 212 starts the print by the print head 11.

Subsequently, at Step S215, the CUP 212 determines whether or not rotation of the second roll R2 has stopped on the basis of detection contents of the optical sensor corresponding to the second roll R2. If the rotation of the second roll R2 has not stopped, the determination is not satisfied (S215: NO), and the routine proceeds to Step S220.

At Step S220, the CPU 212 determines whether or not rotation of the third roll R3 has stopped on the basis of detection contents of the optical sensor corresponding to the third roll R3. If the rotation of the third roll R3 has not stopped, the determination is not satisfied (S20: NO), and the routine proceeds to Step S225.

At Step S225, the CPU 212 determines whether or not the print has been finished with a scheduled length. If the print has not been finished, the determination is not satisfied (S225: NO), the routine returns to Step S215, and the similar procedure is repeated.

On the other hand, if the print has been finished, the determination is satisfied (S225: YES), and the routine proceeds to Step S230.

At Step S230, the CPU 212 stops the print by the print head 11.

Subsequently, at Step S235, the CPU 212 stops the driving of the feeding motor M1, the adhesive take-up motor M2, and the separation sheet take-up motor M3.

Subsequently, at Step S240, the CPU 212 notifies that all the print operations have been normally performed, and the normal mode processing has been finished by displaying the fact on the display portion or the like. Then, this flow is finished.

On the other hand, in the determination at Step S215, if the rotation of the second roll R2 has stopped, the determination is satisfied (S215: YES), and the routine proceeds to Step S245.

At Step S245, the CPU 212 stops the driving of the feeding motor M1, the adhesive take-up motor M2, and the separation sheet take-up motor M3.

Subsequently, at Step S250, the CPU 212 considers that the rotation has stopped since the adhesive tape 150' with print of the second roll R2 is in a jammed state and notifies the fact by displaying it on the display portion or the like. Then, this flow is finished.

On the other hand, in the determination at Step S220, if the rotation of the third roll R3 has stopped, the determination is satisfied (S220: YES), and the routine proceeds to Step S255.

At Step S255, the CPU 212 stops the driving of the feeding motor M1, the adhesive take-up motor M2, and the separation sheet take-up motor M3.

Subsequently, at Step S260, the CPU 212 considers that the rotation has stopped since the separation material layer of the third roll R3 is in a jammed state and notifies the fact by displaying it on the display portion or the like. Then, this flow is finished.

<3. Cutting Mode>

FIGS. 27A to 27C schematically illustrate a process of tape cutting in the cutting mode. When the print has been finished through the normal mode, the feeding roller, the second roll R2, and the third roll R3 all stop rotation. Moreover, at this time, since an outer diameter of the second roll R2 has become larger, a pressing roller 37 is brought into contact with an outer periphery of the second roll R2 and urges it (see FIG. 27A).

The feeding motor M1 and the adhesive take-up motor M2 are controlled so that the feeding roller is stopped and the second roll R2 is rotated in the take-up direction. As a result, a portion in the adhesive tape 150' with print which is to be cut is brought into a state in which a tension works by the feeding roller 12 stopped on the upstream side and the second roll R2 which is to rotate in the take-up direction on the downstream side (see FIG. 27B).

At this time, the separation sheet take-up motor M3 is controlled so that the third roll R3 is also rotated in the take-up direction. Since the third roll R3 is also to rotate in addition to the second roll R2, a stronger tension can be made to work on the adhesive tape 150' with print. Moreover, at this time, even if the separation point (peeling-off position) between the adhesive tape 150' with print and the separation material layer moves to the downstream side by pulling of the adhesive tape 150' with print by the rotation of the above described second roll R2, it can be pulled back to the original position (the tip end position of the peeling-off portion 17) (see a broken line portion in FIG. 27B).

In this state, the adhesive tape 150' with print is cut by the cutter mechanism 30 between the feeding roller 12 and the second roll R2. As a result, loosening of the adhesive tape 150' with print when the cutter mechanism 30 is brought into contact with the edge portion of the adhesive tape 150' with print can be suppressed, and occurrence of defective cutting can be suppressed (see FIG. 27B).

Control is made so that the feeding roller 12 is stopped, and the second roll R2 is rotated in the take-up direction, and then, the adhesive take-up motor M2 is controlled so that the second roll R2 is stopped after rotation in the take-up direction for a predetermined time (See FIG. 27C). That is, after the cutting of the adhesive tape 150' with print by the cutter mechanism is completed, the second roll R2 is not stopped immediately but stopped after rotation for a predetermined time. As a result, since the second roll R2 can be rotated for a predetermined amount after completion of the cutting, a terminal end portion of the adhesive tape 150' with print generated by the cutting can be reliably taken up by the second roll R2. Moreover, at this time, since the pressing roller 37 is urged to the outer periphery of the second roll R2, the terminal end portion of the adhesive tape 150' with print is reliably taken up in the second roll R2.

If the rotation of the second roll R2 is not detected at the time when the terminal end portion of the adhesive tape 150' with print should have been taken up by the second roll R2 as above, it is considered that cutting by the cutter mechanism 30 is defective and the second roll R2 is not rotated, and nonconformity is notified.

Control contents of the cutting mode processing S300 executed by the CPU 212 of the adhesive tape printer 1 in order to realize the control contents above will be described by using FIG. 28.

First, at Step S305, the CPU 212 starts the driving of the adhesive take-up motor M2 and the separation sheet take-up motor M3.

Subsequently, at Step S310, the CPU 212 stands by in a loop until a predetermined time has elapsed since the start of the driving of each of the motors at Step S305. The predetermined time for standby in this case may be such that loosening of the adhesive tape 150' with print from the feeding roller 12 to the second roll R2 is removed, and an appropriate tension can be made to work. Alternatively, the time may be such that loosening of the separation material layer from the feeding roller 12 to the third roll R3 also including the aforementioned pulling back at the separation point is removed, and an appropriate tension can be made to work. When the predetermined time has elapsed, the routine proceeds to Step S315.

At Step S315, the CPU 212 performs the cutting of the adhesive tape 150' with print by an operation of the cutter mechanism 30 by driving the cutter motor.

Subsequently, at Step S320, the CPU 212 determines whether or not the second roll R2 is rotating on the basis of detection contents of the optical sensor corresponding to the second roll R2. If the second roll R2 is rotating, the determination is satisfied (S320: YES), and the routine proceeds to Step S325.

At Step S325, the CPU 212 stands by in a loop until a predetermined time has elapsed since the cutting operation of the cutter mechanism 30 at Step S315. The predetermined time for standby in this case may be such that loosening of the separation material layer from the feeding roller 12 to the third roll R3 including the aforementioned pulling back at the separation point is removed, and an appropriate tension can be made to work. When the predetermined time has elapsed, the routine proceeds to Step S330.

At Step S330, the CPU 212 stops the driving of the separation sheet take-up motor M3.

Subsequently, at Step S335, the CPU 212 stands by in a loop until a predetermined time has elapsed since the cutting operation of the cutter mechanism 30 at Step S315. The predetermined time for standby in this case may be such that the terminal end portion of the adhesive tape 150' with print generated by the cutting can be reliably taken up by the second roll R2. When the predetermined time has elapsed, the routine proceeds to Step S340.

At Step S340, the CPU 212 stops the driving of the adhesive take-up motor M2.

Subsequently, at Step S345, the CPU 212 notifies the fact that the cutting operation has been normally performed, and the cutting mode processing has been finished by displaying it on the display portion or the like. Then, this flow is finished.

On the other hand, in the determination at Step S320, if the second roll R2 is not rotating (has stopped), the determination is not satisfied (S320: NO), and the routine proceeds to Step S350.

At Step S350, the CPU 212 stops the driving of the adhesive take-up motor M2 and the separation sheet take-up motor M3.

Subsequently, at Step S355, the CPU 212 considers that the second roll R2 is not rotating since the cutting by the cutter mechanism 30 is defective and notifies the fact by displaying it on the display portion or the like. Then, this flow is finished.

<Effects by the Present Embodiment>

As described above, in the present embodiment, the adhesive tape 150' with print on which a desired print is applied is taken up around a winding cylinder by the winding core member 40. The winding core member 40 has the shaft member 51, the drum portion 50, the driven gear 52, and the lock member 53 and is constituted by being detachably attached to the housing 2. The driven gear 52 is meshed with the driving gear 38 disposed on the housing 2 when the winding core member 40 is attached to the housing 2. At this time, by fixing the shaft member 51 to the bearing portion 39 by the lock member 53, the drum portion 50 and the driven gear 52 are positioned, and tooth skip in the connection portion between the driving gear 38 and the driven gear 52 can be suppressed. As a result, power of the driving gear 38 can be reliably transmitted to the drum portion 50.

Moreover, in the present disclosure, the lock member 53 which can fix the shaft member 51 to the bearing portion 39 is provided not on the housing 2 of the adhesive tape printer 1 but on the winding core member 40. As a result, it becomes possible to have a structure in which the shaft member 51 swings around the axis (which is the same as the above described axis O2 in this example) by the operation of the lock member 53, and the shaft member 51 is fixed to the bearing portion 39 by engagement, for example. Therefore, the shaft member 51 can be firmly fixed to the bearing portion 39 with an easy operation, and thus, the lock function and the operability can be both realized. Moreover, since a mechanism for advancing/retracting the bearing portion 39 including the spring, the slide button and the like is no longer necessary, the structure can be simplified.

Moreover, particularly in the present embodiment, the lock member 53 is connected to the shaft member 51, and the shaft member 51 in the state fitted with the bearing portion 39 is configured capable of swing around the axis. The shaft member 51 has the first engagement portion 51*a* capable of engagement with the bearing portion 39 in the vicinity of the axis by the swing operation of the lock member at least on one end. As a result, by an extremely simple operation like swing of the lock member 53, the shaft member 51 can be fixed to the bearing portion 39 by engaging the first engagement portion 51*a* of the shaft member 51 with the bearing portion 39, and thus, operability can be reliably improved.

Moreover, the first engagement portion 51*a* of the shaft member 51 is engaged with the bearing portion 39 in the vicinity of the axis. As a result, as compared with engagement at a position away from the axis of the shaft member 51, the shaft member 51 can be fixed to the bearing portion 39 stably and firmly.

Moreover, particularly in the present embodiment, the first engagement portion 51*a* is disposed on the end portion on the one side of the shaft member 51, and the lock member 53 having the second engagement portion 53*c* is connected to the end portion on the other side. As a result, the shaft member 51 and the lock member 53 can be engaged with the bearing portion 39 on the both end portions in the axial direction. Therefore, as compared with engagement only on the one end side in the axial direction, the shaft member 51 can be fixed to the bearing portion 39 stably and firmly.

Moreover, particularly in the present embodiment, the bearing portion 39 is a columnar shaped projection having at least one D-cut portion 39*a*, and the first engagement portion 51*a* and the second engagement portion 53*c* have the round hole portion 71 having a diameter substantially equal to the maximum diameter Db of the bearing portion 39 and the slot portion 72 communicating with the round hole portion 71 and having a width substantially equal to the minimum diameter Ds of the bearing portion 39. With such configuration, when the winding core member 40 is attached to the housing 2, the bearing portion 39 advances into the round hole portion 71 while it is fitted in the slot portions 72 of the first engagement portion 51*a* and the second engagement portion 53*c*. If the lock member 53 and the shaft member 51 swing around the axis by the operation of the lock member 53, the bearing portion 39 relatively rotates in the round hole portion 71 while it is fitted in the round hole portions 71 of the first engagement portion 51*a* and the second engagement portion 53*c*. As a result, the bearing portion 39 can no longer be fitted in the slot portion 72 again or no longer move to the outside of the round hole portion 71. As described above, the first engagement portion 51*a* of the shaft member 51 and the second engagement portion 53*c* and the bearing portion 39 are fixed by the engagement.

In the above described configuration, it is only necessary that the D-cut portion 39*a* is formed on the columnar bearing portion 39, and the round hole portion 71 and the slot portion 72 are formed in the first engagement portion 51*a* of the shaft member 51 and the second engagement portion 53*c* of the lock member 53, respectively, and thus, the lock mechanism can be easily realized without particularly increasing components other than the bearing portion 39, the shaft member 51, and the lock member 53. Therefore, complication of the structure can be reliably suppressed.

Moreover, particularly in the present embodiment, the lock member 53 has the hook portion 53*d* capable of engagement with the projecting portion 36 disposed on the housing 2 when the second engagement portion 53*c* is engaged with the bearing portion 39 by the swing operation. By locking through this hook portion 53*d*, the shaft member 51 can be fixed to the bearing portion 39 further firmly.

Moreover, particularly in the present embodiment, the lock member 53 has the cover portion 53*a* covering the driven gear 52. As a result, occurrence of malfunction caused by adhesion of foreign substances such as dusts to the driven gear 52 can be suppressed, and reliability of the adhesive tape printer 1 can be improved. Moreover, since the lock member 53 has the operation portion 53*b* on the outer periphery of the cover portion 53*a*, the operator can easily perform the swing operation of the lock member 53 by using the operation portion 53*b*, and operability can be further improved.

Moreover, particularly in the present embodiment, there are a plurality of types of the winding core members 40 with different diameters of the drum portion 50. In the adhesive tape printer 1, print is applied while the print-receiving adhesive tape 150 is being fed at a constant speed, and thus, if the diameter of the drum portion 50 is relatively small, the drum portion 50 needs to be rotated fast, while if the diameter of the drum portion 50 is relatively large, the drum portion 50 needs to be rotated slowly.

In the present disclosure, since the cover portion 53*a* of the lock member 53 has the portion to be detected 81, the type of the winding core member 40 can be detected by the detection portion 82 disposed on the housing 2 when the winding core member 40 is attached to the housing. As a result, the rotation speed of the above described drum portion 50 can be changed in accordance with the detection result, and malfunction caused by loosening of the tape can be suppressed.

In the above, the example in which the present disclosure is applied to the adhesive tape printer 1 applying a print to the print-receiving adhesive tape 150 is described, but this is not limiting, and the present disclosure can be applied to a tape processing apparatus for executing processing to the adhesive tape other than print.

Moreover, other than those described above, methods in the above described embodiment and each of the variations may be used in combination as appropriate.

What is claimed is:

1. A lengthy article printer comprising:

a lengthy article take-up apparatus; and a printing portion configured to apply a print on a lengthy article before taking-up, the lengthy article take-up apparatus comprising:

a housing constituting an outer shell of the lengthy article take-up apparatus;

a winding core member detachably attached to said housing and configured to take up said lengthy article;

a bearing portion disposed on said housing; and a driving gear disposed on said housing, wherein said winding core member comprises:

a shaft member configured to be detachably fitted to said bearing portion;

a cylindrical winding body disposed rotatably on an outer periphery of said shaft member and configured to wind said lengthy article on an outer peripheral side;

a driven gear fixed to said cylindrical winding body and configured to be meshed with said driving gear when said winding core member is attached to said housing; and a lock member configured to fix said shaft member to said bearing portion when said winding core member is attached to said housing, said lock member is connected to said shaft member and configured to rotate said shaft member in a state fitted with said bearing portion around an axis of the lock member, said shaft member comprises, at least on one end, a first engagement portion configured to be engaged with said bearing portion in a vicinity of said axis by a rotation operation by said lock member, said shaft member comprises said first engagement portion on an end portion on one side, and an end portion on another side connected to said lock member, and said lock member comprises a second engagement portion configured to be engaged with said bearing portion in the vicinity of said axis by said rotation operation, said housing comprises a projecting portion including an opening portion, and said lock member comprises a hook portion configured to be locked by said projecting portion and overlap said opening portion of said projecting portion in an axial direction of the shaft member when said second engagement portion is engaged with said bearing portion by said rotation operation, and said hook portion is disposed at a position not overlapping with said opening portion of said projecting portion in the axial direction at attaching of said winding core member to said housing.

2. The lengthy article printer according to claim 1, wherein:

said bearing portion is a columnar projection comprising at least one D-cut portion; and said first engagement portion and said second engagement portion each comprise a round hole portion having a diameter substantially equal to a maximum diameter of said bearing portion and a slot portion communicating with said round hole portion and comprising a width substantially equal to a minimum diameter of said bearing portion.

3. The lengthy article printer according to claim 1, wherein:

said hook portion is locked by a lower surface of said projecting portion.

4. The lengthy article printer according to claim 1, further comprising:

a sensor configured to optically detect a lock state of said lock member, wherein said opening portion has a hollow shape opened on a side of the winding core member and configured so that light from said sensor passes through the projecting portion.

5. The lengthy article printer according to claim 4, wherein:

said lock member comprises a cover portion provided with an exposure hole and covering said driven gear; and said exposure hole does not overlap with said opening portion in a case that said lock member is not in the lock state but overlaps with said opening portion in a case that said lock member is in the lock state.

6. The lengthy article printer according to claim 5, wherein:

said driven gear comprises a slit through which the light from said sensor passes.

7. The lengthy article printer according to claim 1, wherein:

a rotating direction of said driven gear driven by said driving gear and a rotation direction of said lock member are configured to be the same direction.

8. The lengthy article printer according to claim 1, wherein said lock member comprises:

a cover portion covering said driven gear; and an operation portion disposed on an outer periphery of said cover portion, wherein said hook portion extends further away from said cylindrical winding body than said cover portion in the axial direction.

9. The lengthy article printer according to claim 8, further comprising a detecting device disposed on said housing and configured to detect a type of the winding core member from a portion of said cover when said winding core member is attached to said housing.

10. A lengthy article printer comprising:

a lengthy article take-up apparatus; and a printing portion configured to apply a print on a lengthy article before taking-up;

the lengthy article take-up apparatus comprising:

a housing constituting an outer shell of the lengthy article take-up apparatus, said housing comprising a projecting portion including an opening portion;

a winding core member detachably attached to said housing and configured to take up said lengthy article;

a bearing portion disposed on said housing; and a driving gear disposed on said housing, wherein said winding core member comprises:

a shaft member configured to be detachably fitted to said bearing portion;

a cylindrical winding body disposed rotatably on an outer periphery of said shaft member and configured to wind said lengthy article on an outer peripheral side;

a driven gear fixed to said cylindrical winding body and configured to be meshed with said driving gear when said winding core member is attached to said housing; and a lock member configured to fix said shaft member to said bearing portion when said winding core member is attached to said housing, said lock member comprising:

a cover portion covering said driven gear;

an operation portion disposed on an outer periphery of said cover portion and configured to receive a user operation to cause a rotation operation in which said lock member rotates about an axis of said shaft member and said lock member;

an engagement portion configured to be engaged with said bearing portion in the vicinity of said axis by said rotation operation; and a hook portion extending further away from said cylindrical winding body than said cover portion in an axial direction of the shaft member, said hook portion configured to be locked by said projecting portion and overlap said opening portion of said projecting portion in an axial direction of the shaft member when said engagement portion is engaged with said bearing portion by said rotation operation, and said hook portion disposed at a position not overlapping with said opening portion of said projecting portion in the axial direction at attaching of said winding core member to said housing.

11. The lengthy article printer according to claim 10, further comprising a detecting device disposed on said housing and configured to detect a type of the winding core member from a portion of said cover when said winding core member is attached to said housing.

* * * * *